US008050430B2

(12) United States Patent
Jiang et al.

(10) Patent No.: US 8,050,430 B2
(45) **Date of Patent: *Nov. 1, 2011**

(54) THERMOACOUSTIC DEVICE

(75) Inventors: Kai-Li Jiang, Beijing (CN); Lin Xiao, Beijing (CN); Zhuo Chen, Beijing (CN); Chen Feng, Beijing (CN); Shou-Shan Fan, Beijing (CN); Yuan-Chao Yang, Beijing (CN)

(73) Assignees: Beijing FUNATE Innovation Technology Co., Ltd., Beijing (CN); Hon Hai Precision Industry Co., Ltd., Tu-Cheng, New Taipei (TW)

( * ) Notice: Subject to any disclaimer, the term of this patent is extended or adjusted under 35 U.S.C. 154(b) by 216 days.

This patent is subject to a terminal disclaimer.

(21) Appl. No.: 12/459,046

(22) Filed: Jun. 25, 2009

(65) Prior Publication Data

US 2009/0323476 A1 Dec. 31, 2009

Related U.S. Application Data

(63) Continuation of application No. 12/387,089, filed on Apr. 28, 2009.

(30) Foreign Application Priority Data

| | | |
|---|---|---|
| Apr. 28, 2008 | (CN) | 2008 1 0066693 |
| Jun. 4, 2008 | (CN) | 2008 1 0067586 |
| Jun. 4, 2008 | (CN) | 2008 1 0067589 |
| Jun. 4, 2008 | (CN) | 2008 1 0067638 |
| Jun. 18, 2008 | (CN) | 2008 1 0067905 |
| Jun. 18, 2008 | (CN) | 2008 1 0067906 |
| Jun. 18, 2008 | (CN) | 2008 1 0067907 |
| Jun. 18, 2008 | (CN) | 2008 1 0067908 |
| Dec. 5, 2008 | (CN) | 2008 1 0218230 |
| Feb. 27, 2009 | (CN) | 2009 1 0105808 |

(51) Int. Cl.
*H04R 25/00* (2006.01)

(52) U.S. Cl. ..... 381/164; 381/426

(58) Field of Classification Search ..... 381/164
See application file for complete search history.

(56) References Cited

U.S. PATENT DOCUMENTS 1,528,774 A * 3/1925 Kranz ..... 324/142

(Continued)

FOREIGN PATENT DOCUMENTS

CN 2787870 6/2006

(Continued)

OTHER PUBLICATIONS

Arnold, H.D., Crandall I.B.; "The Thermophone as a Precision Source of Sound"; Jul. 1917; The American Physical Society Rev.; vol. 10, pp. 22-38.*

(Continued)

*Primary Examiner* — Curtis Kuntz
*Assistant Examiner* — Ryan Robinson
(74) *Attorney, Agent, or Firm* — Altis Law Group, Inc.

(57) ABSTRACT

A sound wave generator includes one or more carbon nanotube films. The carbon nanotube film includes a plurality of carbon nanotubes substantially parallel to each other and joined side by side via van der Waals attractive force therebetween. At least part of the sound wave generator is supported by a supporting element. The one or more carbon nanotube films produce sound by means of the thermoacoustic effect.

28 Claims, 21 Drawing Sheets

U.S. PATENT DOCUMENTS

| | | | | |
|---|---|---|---|---|
| 4,334,321 | A | 6/1982 | Edelman | |
| 4,503,564 | A | 3/1985 | Edelman et al. | |
| 4,641,377 | A | 2/1987 | Rush et al. | |
| 4,766,607 | A | 8/1988 | Feldman | |
| 5,694,477 | A | 12/1997 | Kole | |
| 6,473,625 | B1 | 10/2002 | Williams et al. | |
| 6,803,116 | B2 * | 10/2004 | Ikeda | 428/546 |
| 6,808,746 | B1 | 10/2004 | Dai et al. | |
| 6,921,575 | B2 | 7/2005 | Horiuchi et al. | |
| 7,045,108 | B2 | 5/2006 | Jiang et al. | |
| 7,393,428 | B2 | 7/2008 | Huang et al. | |
| 7,723,684 | B1 * | 5/2010 | Haddon et al. | 250/338.1 |
| 7,799,163 | B1 | 9/2010 | Mau et al. | |
| 2001/0005272 | A1 | 6/2001 | Buchholz | |
| 2005/0040371 | A1 | 2/2005 | Watanabe et al. | |
| 2005/0201575 | A1 | 9/2005 | Koshida et al. | |
| 2006/0147081 | A1 * | 7/2006 | Mango et al. | 381/398 |
| 2007/0166223 | A1 | 7/2007 | Jiang et al. | |
| 2008/0095694 | A1 | 4/2008 | Nakayama et al. | |
| 2008/0170982 | A1 * | 7/2008 | Zhang et al. | 423/447.3 |
| 2009/0016951 | A1 | 1/2009 | Kawabata et al. | |
| 2009/0145686 | A1 | 6/2009 | Watabe et al. | |

FOREIGN PATENT DOCUMENTS

| | | |
|---|---|---|
| CN | 1821048 | 8/2006 |
| JP | 2003198281 | 7/2003 |
| JP | 2004229250 | 8/2004 |
| JP | 2005189322 | 7/2005 |
| JP | 2005333601 | 12/2005 |
| WO | WO0073204 | 12/2000 |
| WO | WO2007099975 | 9/2007 |

OTHER PUBLICATIONS

Amos, S.W.; "Principles of Transistor Circuits"; 2000; Newnes-Butterworth-Heinemann; 9th ed.;p. 114.

Strutt John William, Rayleigh Baron, The Theory of Sound, 1926, pp. 226-235, vol. 2.

Swift Gregory W., Thermoacoustic Engines and Refrigerators, Physics Today, Jul. 1995, pp. 22-28, vol. 48.

H.D. Arnold, I.B. Crandall, The Thermophone as a Precision Source of Sound, Physical Review, 1917, pp. 22-38, vol. 10.

Frank P. Incropera, David P. Dewitt et al., Fundamentals of Heat and Mass Transfer, 6th ed., 2007, pp. A-5, Wiley:Asia.

Kaili Jiang, Qunqing Li, Shoushan Fan, Spinning continuous carbon nanotube yarns, Nature, Oct. 24, 2002, pp. 801, vol. 419.

Lin Xiao, Zhuo Chen, Chen Feng, Liang Liu et al., Flexible, Stretchable, Transparent Carbon Nanotube Thin Film Loudspeakers, Nano Letters, 2008, pp. 4539-4545, vol. 8, No. 12, US.

Kai Liu, Yinghui Sun, Lei Chen, Chen Feng, Xiaofeng Feng, Kaili Jiang et al., Controlled Growth of Super-Aligned Carbon Nanotube Arrays for Spinning Continuous Unidirectional Sheets with Tunable Physical Properties, Nano Letters, 2008, pp. 700-705, vol. 8, No. 2.

Lina Zhang, Chen Feng, Zhuo Chen, Liang Liu et al., Superaligned Carbon Nanotube Grid for High Resolution Transmission Electron Microscopy of Nanomaterials, Nano Letters, 2008, pp. 2564-2569, vol. 8, No. 8.

Zhuangchun Wu, Zhihong Chen, Xu Du et al.,Transparent, Conductive Carbon Nanotube Films, Science, Aug. 27, 2004, pp. 1273-1276, vol. 305.

P. De Lange, On Thermophones, Proceedings of the Royal Society of London. Series A, Apr. 1, 1915, pp. 239-241, vol. 91, No. 628.

Xiaobo Zhang, Kaili Jiang, Chen Feng, Peng Liu et al., Spinning and Processing Continuous Yarns from 4-Inch Wafer Scale Super-Aligned Carbon Nanotube Arrays, Advanced Materials, 2006, pp. 1505-1510, vol. 18.

Edward C. Wente, The Thermophone, Physical Review, 1922, pp. 333-345,vol. 19.

J.J.Hopfield, Spectra of Hydrogen, Nitrogen and Oxygen in the Extreme Ultraviolet, Physical Review, 1922, pp. 573-588,vol. 20.

http://www.physorg.com/news123167268.html.

William Henry Preece, On Some Thermal Effects of Electric Currents, Proceedings of the Royal Society of London, 1879-1880, pp. 408-411, vol. 30.

Braun Ferdinand, Notiz uber Thermophonie, Ann. Der Physik, Apr. 1898, pp. 358-360,vol. 65.

Mei Zhang, Shaoli Fang, Anvar A. Zakhidov, Sergey B. Lee et al., Strong, Transparent, Multifunctional, Carbon Nanotube Sheets, Science, Aug. 19, 2005, pp. 1215-1219, vol. 309.

Yang Wei, Kaili Jiang, Xiaofeng Feng, Peng Liu et al., Comparative studies of multiwalled carbon nanotube sheets before and after shrinking, Physical Review B, Jul. 25, 2007, vol. 76, 045423.

W. Yi, L.Lu, Zhang Dianlin et al., Linear Specific Heat of Carbon Nanotubes, Physical Review B, Apr. 1, 1999, vol. 59, No. 14, R9015-9018.

Lee et al., Photosensitization of nonlinear scattering and photoacoustic emission from single-walled carbon nanotubes, Applied Physics Letters, Mar. 13, 2008, 92, 103122.

Alexander Graham Bell, Selenium and the Photophone, Nature, Sep. 23, 1880, pp. 500-503.

Silvanus P. Thompson, The Photophone, Nature, Sep. 23, 1880, vol. XXII, No. 569, pp. 481.

* cited by examiner

THERMOACOUSTIC DEVICE

RELATED APPLICATIONS

This application is related to copending applications: U.S. patent application Ser. No. 12/459,051, entitled, "THERMOACOUSTIC DEVICE", filed Jun. 25, 2009; U.S. patent application Ser. No. 12/459,052, entitled, "THERMOACOUSTIC DEVICE", filed Jun. 25, 2009; U.S. patent application Ser. No. 12/459,039, entitled, "THERMOACOUSTIC DEVICE", filed Jun. 25, 2009; U.S. patent application Ser. No. 12/459,041, entitled, "THERMOACOUSTIC DEVICE", filed Jun. 25, 2009; U.S. patent application Ser. No. 12/459,054, entitled, "THERMOACOUSTIC DEVICE", filed Jun. 25, 2009; U.S. patent application Ser. No. 12/459,053, entitled, "THERMOACOUSTIC DEVICE", filed Jun. 25, 2009; U.S. patent application Ser. No. 12/459,040, entitled, "THERMOACOUSTIC DEVICE", filed Jun. 25, 2009; and U.S. patent application Ser. No. 12/459,038, entitled, "THERMOACOUSTIC DEVICE", filed Jun. 25, 2009.

BACKGROUND

1. Technical Field

The present disclosure relates to acoustic devices and method for generating sound waves, particularly, to a carbon nanotube based thermoacoustic device and method for generating sound waves using the thermoacoustic effect.

2. Description of Related Art

Acoustic devices generally include a signal device and a sound wave generator. The signal device inputs signals to the sound wave generator such as a loudspeaker. Loudspeaker is an electro-acoustic transducer that converts electrical signals into sound.

There are different types of loudspeakers that can be categorized according by their working principles, such as electro-dynamic loudspeakers, electromagnetic loudspeakers, electrostatic loudspeakers and piezoelectric loudspeakers. However, the various types ultimately use mechanical vibration to produce sound waves, in other words they all achieve "electro-mechanical-acoustic" conversion. Among the various types, the electro-dynamic loudspeakers are most widely used.

Referring to FIG. 21, the electro-dynamic loudspeaker 100, according to the prior art, typically includes a voice coil 102, a magnet 104 and a cone 106. The voice coil 102 is an electrical conductor, and is placed in the magnetic field of the magnet 104. By applying an electrical current to the voice coil 102, a mechanical vibration of the cone 106 is produced due to the interaction between the electromagnetic field produced by the voice coil 102 and the magnetic field of the magnets 104, thus producing sound waves by kinetically pushing the air. However, the structure of the electric-powered loudspeaker 100 is dependent on magnetic fields and often weighty magnets.

Thermoacoustic effect is a conversion between heat and acoustic signals. The thermoacoustic effect is distinct from the mechanism of the conventional loudspeaker, which the pressure waves are created by the mechanical movement of the diaphragm. When signals are inputted into a thermoacoustic element, heating is produced in the thermoacoustic element according to the variations of the signal and/or signal strength. Heat is propagated into surrounding medium. The heating of the medium causes thermal expansion and produces pressure waves in the surrounding medium, resulting in sound wave generation. Such an acoustic effect induced by temperature waves is commonly called "the thermoacoustic effect".

A thermophone based on the thermoacoustic effect was created by H. D. Arnold and I. B. Crandall (H. D. Arnold and I. B. Crandall, "The thermophone as a precision source of sound", Phys. Rev. 10, pp 22-38 (1917)). They used platinum strip with a thickness of $7\times10^{-5}$ cm as a thermoacoustic element. The heat capacity per unit area of the platinum strip with the thickness of $7\times10^{-5}$ cm is $2\times10^{-4}$ J/cm$^2$*K. However, the thermophone adopting the platinum strip, listened to the open air, sounds extremely weak because the heat capacity per unit area of die platinum strip is too high.

What is needed, therefore, is to provide an effective thermoacoustic device having a simple lightweight structure that is not dependent on magnetic fields, able to produce sound without the use of vibration, and able to move and flex without an effect on the sound waves produced.

BRIEF DESCRIPTION OF THE DRAWINGS

Many aspects of the present thermoacoustic device and method for generating sound waves can be better understood with reference to the following drawings. The components in the drawings are not necessarily to scale, the emphasis instead being placed upon clearly illustrating the principles of the present thermoacoustic device and method for generating sound waves.

Figure 1:
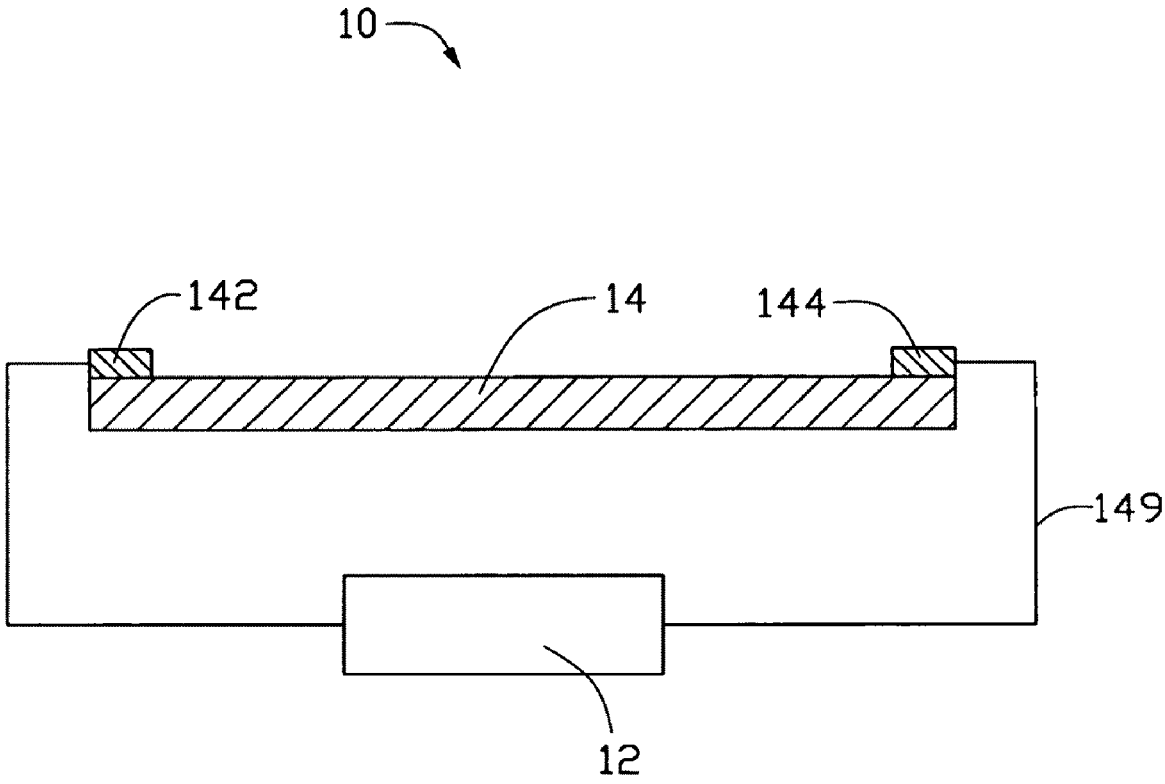
FIG. 1 is a schematic structural view of a thermoacoustic device in accordance with one embodiment.

Corresponding reference characters indicate corresponding parts throughout the several views. The exemplifications set out herein illustrate at least one exemplary embodiment of the present thermoacoustic device and method for generating sound waves, in at least one form, and such exemplifications are not to be construed as limiting the scope of the invention in any manner.

DETAILED DESCRIPTION OF EXEMPLARY EMBODIMENTS

Reference will now be made to the drawings to describe, in detail, embodiments of the present thermoacoustic device and method for generating sound waves.

Referring to FIG. 1, a thermoacoustic device 10 according to one embodiment includes a signal device 12, a sound wave generator 14, a first electrode 142, and a second electrode 144. The first electrode 142 and the second electrode 144 are located apart from each other, and are electrically connected to the sound wave generator 14. In addition, the first electrode 142 and the second electrode 144 are electrically connected to the signal device 12. The first electrode 142 and the second electrode 144 input signals from the signal device 12 to the sound wave generator 14.

The sound wave generator 14 includes a carbon nanotube structure. The carbon nanotube structure can have a many different structures and a large specific surface area. The heat capacity per unit area of the carbon nanotube structure can be less than $2\times10^{-4}$ J/cm$^2$*K. In one embodiment, the heat capacity per unit area of the carbon nanotube structure is less than or equal to about $1.7\times10^{-6}$ J/cm$^2$*K. The carbon nanotube structure can include a plurality of carbon nanotubes uniformly distributed therein, and the carbon nanotubes therein can be combined by van der Waals attractive force therebetween. It is understood that the carbon nanotube structure must include metallic carbon nanotubes. The carbon nanotubes in the carbon nanotube structure can be arranged orderly or disorderly. The term 'disordered carbon nanotube structure' includes a structure where the carbon nanotubes are arranged along many different directions, arranged such that the number of carbon nanotubes arranged along each different direction can be almost the same (e.g. uniformly disordered); and/or entangled with each other. 'Ordered carbon nanotube structure' includes a structure where the carbon nanotubes are arranged in a consistently systematic manner, e.g., the carbon nanotubes are arranged approximately along a same direction and or have two or more sections within each of which the carbon nanotubes are arranged approximately along a same direction (different sections can have different directions). The carbon nanotubes in the carbon nanotube structure can be selected from single-walled, double-walled, and/or multi-walled carbon nanotubes. It is also understood that there may be many layers of ordered and/or disordered carbon nanotube films in the carbon nanotube structure.

The carbon nanotube structure may have a substantially planar structure. The thickness of the carbon nanotube structure may range from about 0.5 nanometers to about 1 millimeter. The smaller the specific surface area of the carbon nanotube structure, the greater the heat capacity will be per unit area. The larger the heat capacity per unit area, the smaller the sound pressure level of the thermoacoustic device.

Figure 2:
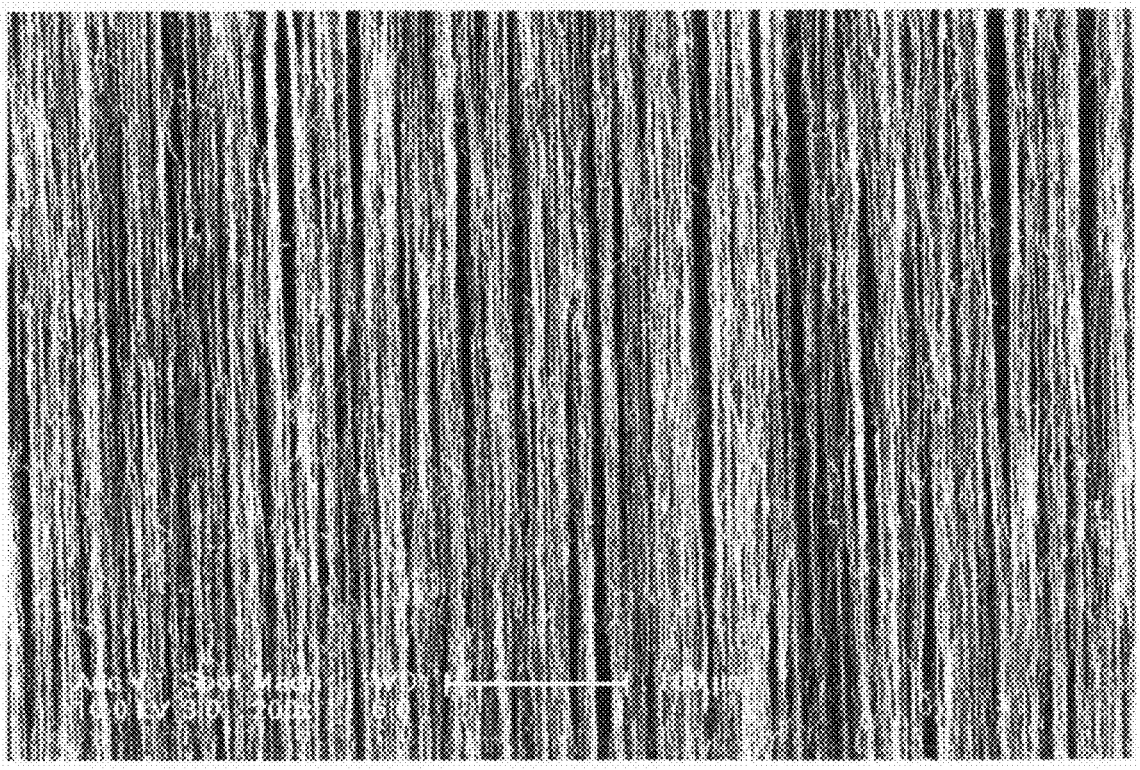
FIG. 2 shows a Scanning Electron Microscope (SEM) image of an aligned carbon nanotube film.
Figure 3:
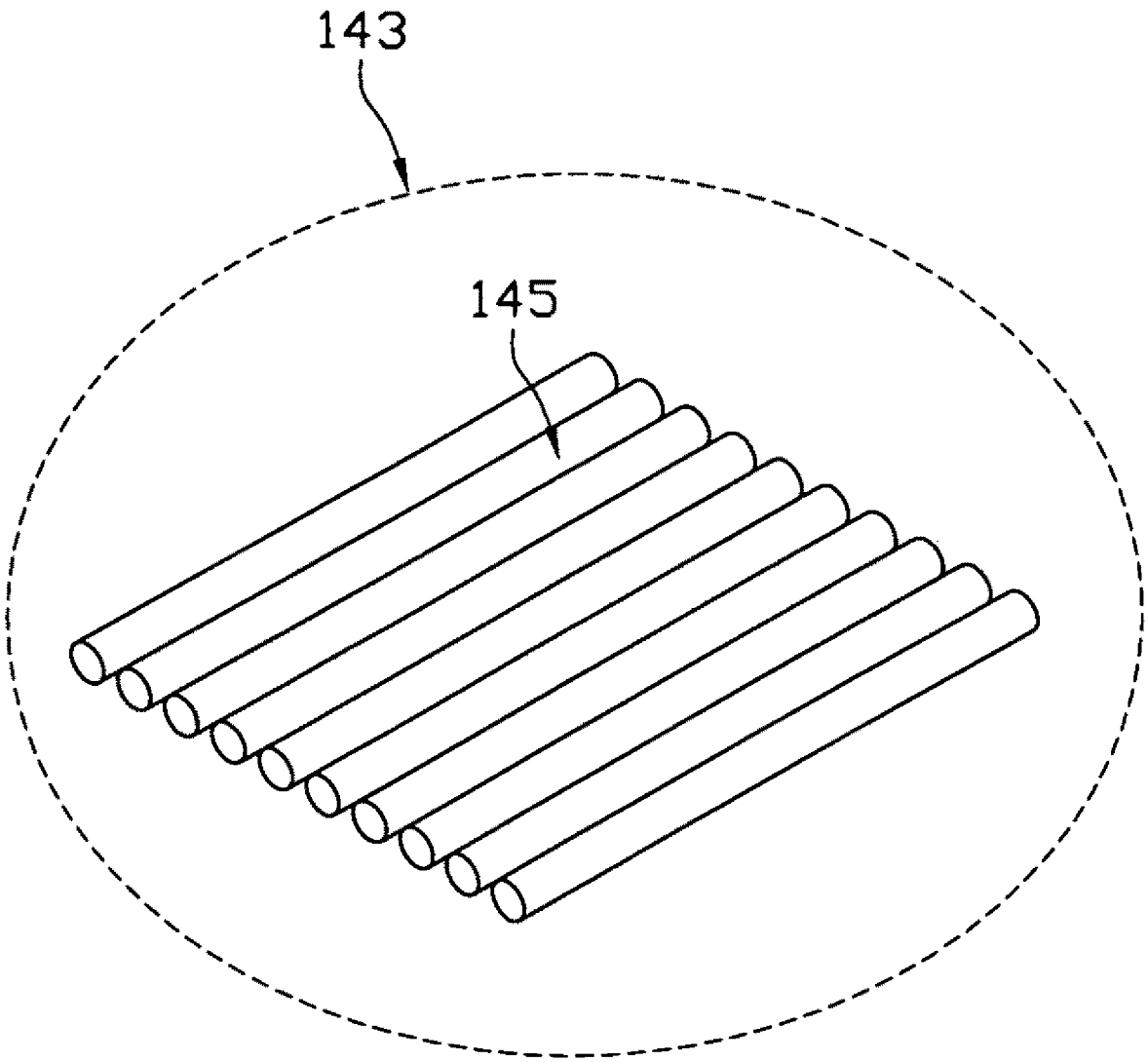
FIG. 3 is a schematic structural view of a carbon nanotube segment.

In one embodiment, the carbon nanotube structure can include at least one drawn carbon nanotube film. Examples of a drawn carbon nanotube film is taught by U.S. Pat. No. 7,045,108 to Jiang et al., and WO 2007015710 to Zhang et al. The drawn carbon nanotube film includes a plurality of successive and oriented carbon nanotubes joined end-to-end by van der Waals attractive force therebetween. The carbon nanotubes in the carbon nanotube film can be substantially aligned in a single direction. The drawn carbon nanotube film can be formed by drawing a film from a carbon nanotube array that is capable of having a film drawn therefrom. Referring to FIGS. 2 to 3, each drawn carbon nanotube film includes a plurality of successively oriented carbon nanotube segments 143 joined end-to-end by van der Waals attractive force therebetween. Each carbon nanotube segment 143 includes a plurality of carbon nanotubes 145 parallel to each other, and combined by van der Waals attractive force therebetween. As can be seen in FIG. 2, some variations can occur in the drawn carbon nanotube film. The carbon nanotubes 145 in the drawn carbon nanotube film are also oriented along a preferred orientation. The carbon nanotube film also can be treated with an organic solvent. After that, the mechanical strength and toughness of the treated carbon nanotube film are increased and the coefficient of friction of the treated carbon nanotube films is reduced. The treated carbon nanotube film has a larger heat capacity per unit area and thus produces less of a thermoacoustic effect than the same film before treatment. A thickness of the carbon nanotube film can range from about 0.5 nanometers to about 100 micrometers.

The carbon nanotube structure of the sound wave generator 14 also can include at least two stacked carbon nanotube films. In other embodiments, the carbon nanotube structure can include two or more coplanar carbon nanotube films. These coplanar carbon nanotube films can also be stacked one upon other films. Additionally, an angle can exist between the orientation of carbon nanotubes in adjacent films, stacked and/or coplanar. Adjacent carbon nanotube films can be combined only by the van der Waals attractive force therebetween. The number of the layers of the carbon nanotube films is not limited. However, a large enough specific surface area must be maintained to achieve the thermoacoustic effect. An angle between the aligned directions of the carbon nanotubes in the two adjacent carbon nanotube films can range from 0° to about 90°. When the angle between the aligned directions of the carbon nanotubes in adjacent carbon nanotube films is larger than 0 degrees, a microporous structure is defined by the carbon nanotubes in the sound wave generator 14. The carbon nanotube structure in an embodiment employing these films will have a plurality of micropores. Stacking the carbon nanotube films will add to the structural integrity of the carbon nanotube structure. In some embodiments, the carbon nanotube structure has a free standing structure and does not require the use of structural support.

Figure 4:
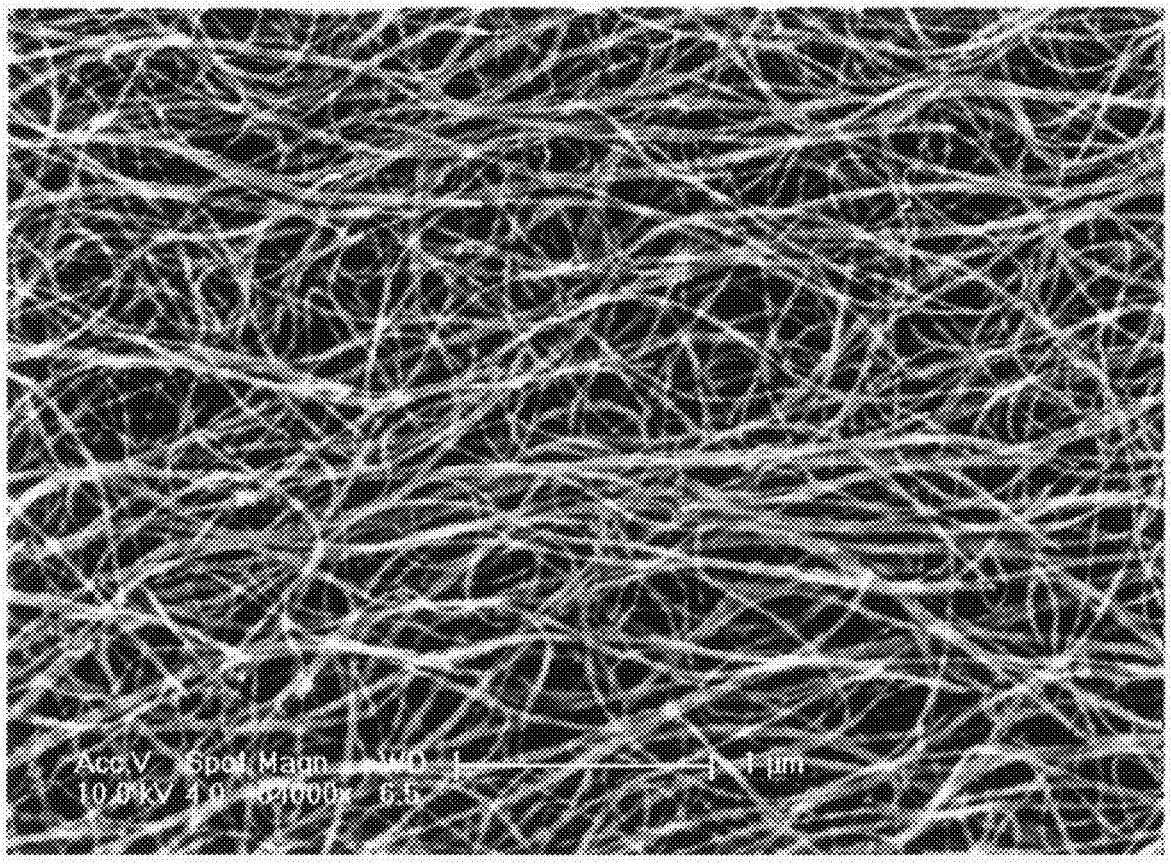
FIG. 4 shows an SEM image of another carbon nanotube film with carbon nanotubes entangled with each other therein.

In other embodiments, the carbon nanotube structure includes a flocculated carbon nanotube film. Referring to FIG. 4, the flocculated carbon nanotube film can include a plurality of long, curved, disordered carbon nanotubes entangled with each other. A length of the carbon nanotubes can be above 10 centimeters. Further, the flocculated carbon nanotube film can be isotropic. The carbon nanotubes can be substantially uniformly dispersed in the carbon nanotube film. The adjacent carbon nanotubes are acted upon by the van der Waals attractive force therebetween, thereby forming an entangled structure with micropores defined therein. It is understood that the flocculated carbon nanotube film is very porous. Sizes of the micropores can be less than 10 micrometers. The porous nature of the flocculated carbon nanotube film will increase specific surface area of the carbon nanotube structure. Further, due to the carbon nanotubes in the carbon nanotube structure being entangled with each other, the carbon nanotube structure employing the flocculated carbon nanotube film has excellent durability, and can be fashioned into desired shapes with a low risk to the integrity of carbon nanotube structure. Thus, the sound wave generator 14 may be formed into many shapes. The flocculated carbon nanotube film, in some embodiments, will not require the use of structural support due to the carbon nanotubes being entangled and adhered together by van der Waals attractive force therebetween. The thickness of the flocculated carbon nanotube film can range from about 0.5 nanometers to about 1 millimeter. It is also understood that many of the embodiments of the carbon nanotube structure are flexible and/or do not require the use of structural support to maintain their structural integrity.

Figure 5:
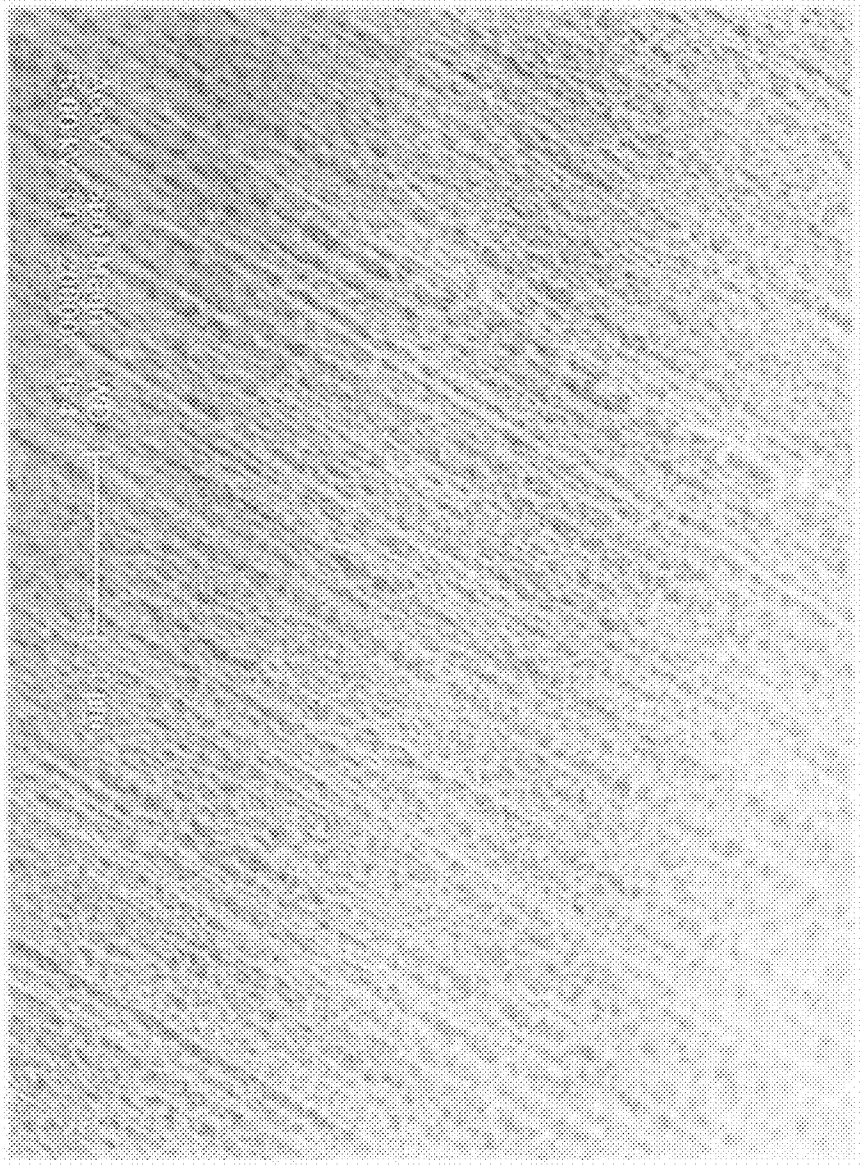
FIG. 5 shows an SEM image of a carbon nanotube film segment with the carbon nanotubes therein arranged along a preferred orientation.

In other embodiments, the carbon nanotube structure includes a carbon nanotube film that comprises one carbon nanotube segment. Referring to FIG. 5, the carbon nanotube segment includes a plurality of carbon nanotubes arranged along a preferred orientation. The carbon nanotube segment is a carbon nanotube film that comprises one carbon nanotube segment. The carbon nanotube segment includes a plurality of carbon nanotubes arranged along a same direction. The carbon nanotubes in the carbon nanotube segment are substantially parallel to each other, have an almost equal length and are combined side by side via van der Waals attractive force therebetween. At least one carbon nanotube will span the entire length of the carbon nanotube segment in a carbon nanotube film. Thus, one dimension of the carbon nanotube segment is only limited by the length of the carbon nanotubes.

The carbon nanotube structure can further include at least two stacked and/or coplanar carbon nanotube segments. Adjacent carbon nanotube segments can be adhered together by van der Waals attractive force therebetween. An angle between the aligned directions of the carbon nanotubes in adjacent two carbon nanotube segments ranges from 0 degrees to about 90 degrees. A thickness of a single carbon nanotube segment can range from about 0.5 nanometers to about 100 micrometers.

In some embodiments, the carbon nanotube film can be produced by growing a strip-shaped carbon nanotube array, and pushing the strip-shaped carbon nanotube array down along a direction perpendicular to length of the strip-shaped carbon nanotube array, and has a length ranged from about 20 micrometers to about 10 millimeters. The length of the carbon nanotube film is only limited by the length of the strip. A larger carbon nanotube film also can be formed by having a plurality of these strips lined up side by side and folding the carbon nanotubes grown thereon over such that there is overlap between the carbon nanotubes on adjacent strips.

In some embodiments, the carbon nanotube film can be produced by a method adopting a "kite-mechanism" and can have carbon nanotubes with a length of even above 10 centimeters. This is considered by some to be ultra-long carbon nanotubes. However, this method can be used to grow carbon nanotubes of many sizes. Specifically, the carbon nanotube film can be produced by providing a growing substrate with a catalyst layer located thereon; placing the growing substrate adjacent to the insulating substrate in a chamber; and heating the chamber to a growth temperature for carbon nanotubes under a protective gas, and introducing a carbon source gas along a gas flow direction, growing a plurality of carbon nanotubes on the insulating substrate. After introducing the carbon source gas into the chamber, the carbon nanotubes starts to grow under the effect of the catalyst. One end (e.g., the root) of the carbon nanotubes is fixed on the growing substrate, and the other end (e.g., the top/free end) of the carbon nanotubes grow continuously. The growing substrate is near an inlet of the introduced carbon source gas, the ultralong carbon nanotubes float above the insulating substrate with the roots of the ultralong carbon nanotubes still sticking on the growing substrate, as the carbon source gas is continuously introduced into the chamber. The length of the ultralong carbon nanotubes depends on the growth conditions. After growth has been stopped, the ultralong carbon nanotubes land on the insulating substrate. The carbon nanotubes roots are then separated from the growing substrate. This can be repeated many times so as to obtain many layers of carbon nanotube films on a single insulating substrate. By rotating the insulating substrate after a growth cycle, adjacent layers may have an angle from 0 to less than or equal to 90 degrees.

Furthermore, the carbon nanotube film and/or the entire carbon nanotube structure can be treated, such as by laser, to improve the light transmittance of the carbon nanotube film or the carbon nanotube structure. For example, the light transmittance of the untreated drawn carbon nanotube film ranges from about 70%-80%, and after laser treatment, the light transmittance of the untreated drawn carbon nanotube film can be improved to about 95%. The heat capacity per unit area of the carbon nanotube film and/or the carbon nanotube structure will increase after the laser treatment.

In other embodiments, the carbon nanotube structure includes one or more carbon nanotube wire structures. The carbon nanotube wire structure includes at least one carbon nanotube wire. A heat capacity per unit area of the carbon nanotube wire structure can be less than $2\times10^{-4}$ J/cm$^2$*K. In one embodiment, the heat capacity per unit area of the carbon nanotube wire structure is less than $5\times10^{-5}$ J/cm$^2$*K. The carbon nanotube wire can be twisted or untwisted. The carbon nanotube wire structure includes carbon nanotube cables that comprise of twisted carbon nanotube wires, untwisted carbon nanotube wires, or combinations thereof. The carbon nanotube cable comprises of two or more carbon nanotube wires, twisted or untwisted, that are twisted or bundled together. The carbon nanotube wires in the carbon nanotube wire structure can be parallel to each other to form a bundle-like structure or twisted with each other to form a twisted structure.

Figure 6:
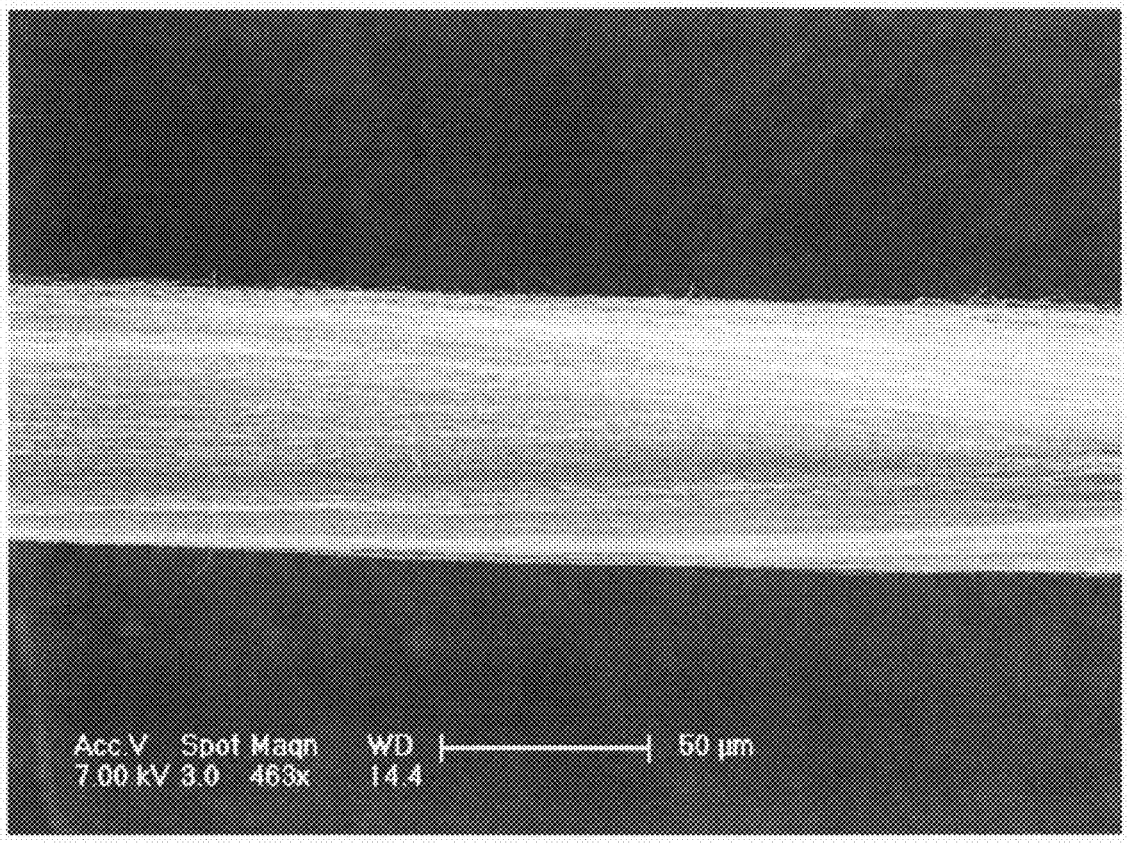
FIG. 6 shows an SEM image of an untwisted carbon nanotube wire.

The untwisted carbon nanotube wire can be formed by treating the drawn carbon nanotube film with a volatile organic solvent. Specifically, the drawn carbon nanotube film is treated by applying the organic solvent to the drawn carbon nanotube film to soak the entire surface of the drawn carbon nanotube film. After being soaked by the organic solvent, the adjacent paralleled carbon nanotubes in the drawn carbon nanotube film will bundle together, due to the surface tension of the organic solvent when the organic solvent volatilizing, and thus, the drawn carbon nanotube film will be shrunk into untwisted carbon nanotube wire. Referring to FIG. 6, the untwisted carbon nanotube wire includes a plurality of carbon nanotubes substantially oriented along a same direction (e.g., a direction along the length of the untwisted carbon nanotube wire). The carbon nanotubes are substantially parallel to the axis of the untwisted carbon nanotube wire. Length of the untwisted carbon nanotube wire can be set as desired. The diameter of an untwisted carbon nanotube wire can range from about 0.5 nanometers to about 100 micrometers. In one embodiment, the diameter of the untwisted carbon nanotube wire is about 50 micrometers. Examples of the untwisted carbon nanotube wire is taught by US Patent Application Publication US 2007/0166223 to Jiang et al.

Figure 7:
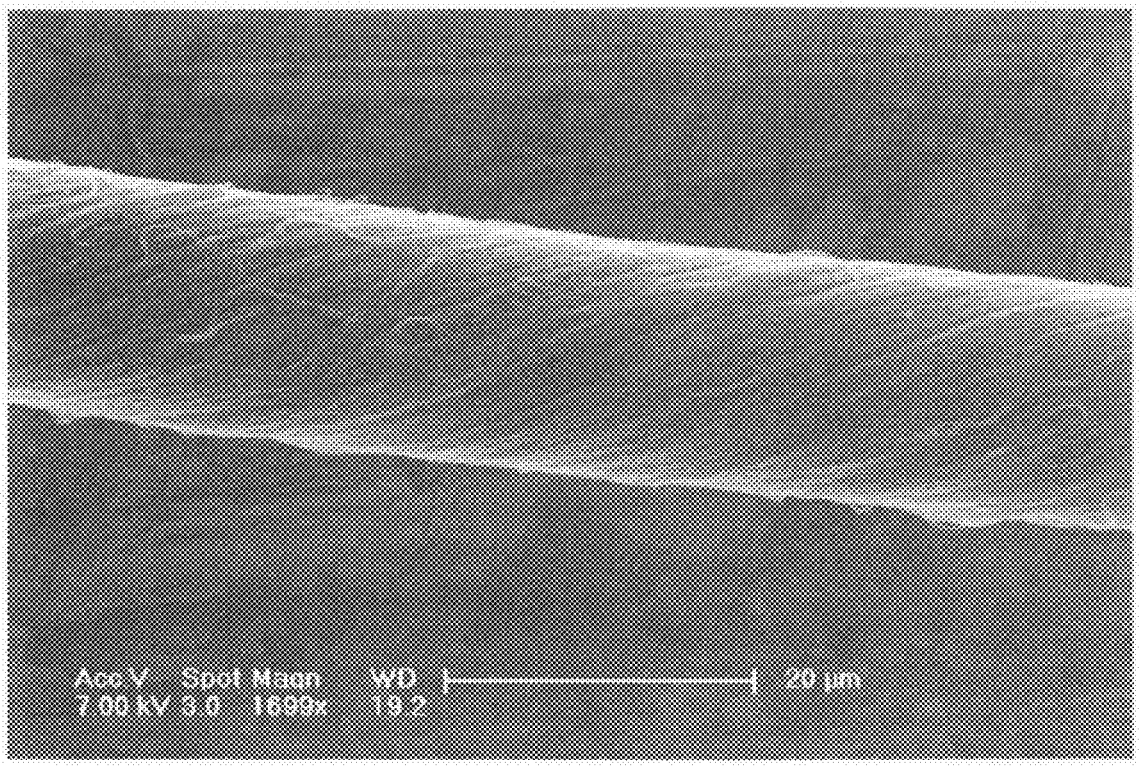
FIG. 7 shows a Scanning Electron Microscope (SEM) image of a twisted carbon nanotube wire.

The twisted carbon nanotube wire can be formed by twisting a drawn carbon nanotube film by using a mechanical force to turn the two ends of the drawn carbon nanotube film in opposite directions. Referring to FIG. 7, the twisted carbon nanotube wire includes a plurality of carbon nanotubes oriented around an axial direction of the twisted carbon nanotube wire. The carbon nanotubes are aligned around the axis of the carbon nanotube twisted wire like a helix. Length of the carbon nanotube wire can be set as desired. The diameter of the twisted carbon nanotube wire can range from about 0.5 nanometers to about 100 micrometers. Further, the twisted carbon nanotube wire can be treated with a volatile organic solvent, before or after being twisted. After being soaked by the organic solvent, the adjacent paralleled carbon nanotubes in the twisted carbon nanotube wire will bundle together, due to the surface tension of the organic solvent when the organic solvent volatilizing. The specific surface area of the twisted carbon nanotube wire will decrease. The density and strength of the twisted carbon nanotube wire will be increased. It is understood that the twisted and untwisted carbon nanotube cables can be produced by methods that are similar to the methods of making twisted and untwisted carbon nanotube wires.

Figure 8:
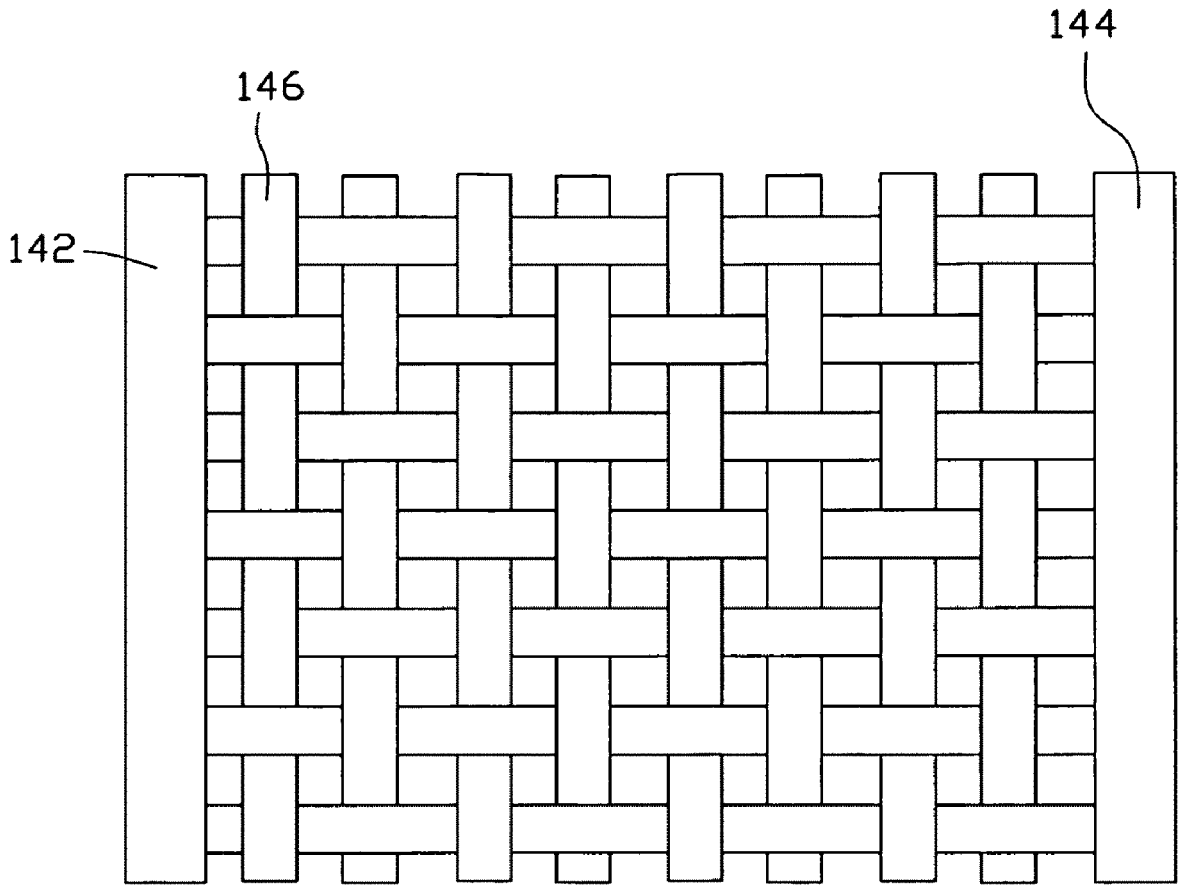
FIG. 8 shows schematic of a textile formed by a plurality of carbon nanotube wires and/or films.

The carbon nanotube structure can include a plurality of carbon nanotube wire structures. The plurality of carbon nanotube wire structures can be paralleled with each other, cross with each other, weaved together, or twisted with each other. The resulting structure can be a planar structure if so desired. Referring to FIG. 8, a carbon nanotube textile can be formed by the carbon nanotube wire structures 146 and used as the carbon nanotube structure. The first electrode 142 and the second electrode 144 can be located at two opposite ends of the textile and electrically connected to the carbon nanotube wire structures 146. It is also understood that the carbon nanotube textile can also be formed by treated and/or untreated carbon nanotube films.

The carbon nanotube structure has a unique property of being flexible. The carbon nanotube structure can be tailored or folded into many shapes and put onto a variety of rigid or flexible insulating surfaces, such as on a flag or on clothes. The flag having the carbon nanotube structure can act as the sound wave generator 14 as it flaps in the wind. The sound produced is not affected by the motion of the flag. Additionally, the flags ability to move is not substantially effected given the lightweight flexible nature of the carbon nanotube structure. Clothes having the carbon nanotube structure can attach to a MP3 player and play music. Additionally, such clothes could be used to help the handicap, such as the hearing impaired.

The sound wave generator having a carbon nanotube structure comprising of one or more aligned drawn films has another striking property. It is stretchable perpendicular to the alignment of the carbon nanotubes. The carbon nanotube structure can be put on two springs that serve also as the first and the second electrodes 142, 144. When the springs are uniformly stretched along a direction perpendicular to the arranged direction of the carbon nanotubes, the carbon nanotube structure is also stretched along the same direction. The carbon nanotube structure can be stretched to 300% of its original size, and can become more transparent than before stretching. In one embodiment, the carbon nanotube structure adopting one layer carbon nanotube drawn film is stretched to 200% of its original size, and the light transmittance of the carbon nanotube structure is about 80% before stretching and increased to about 90% after stretching. The sound intensity is almost unvaried during stretching. The stretching properties of the carbon nanotube structure may be widely used in stretchable consumer electronics and other devices that are unable to use speakers of the prior art.

The sound wave generator is also able to produce sound waves even when a part of the carbon nanotube structure is punctured and/or torn. Also during the stretching process, if part of the carbon nanotube structure is punctured and/or torn, the carbon nanotube structure is able to produce sound waves too. This will be impossible for a vibrating film or a cone of a conventional loudspeaker.

In the embodiment shown in FIG. 1, the sound wave generator 14 includes a carbon nanotube structure comprising the drawn carbon nanotube film, and the drawn carbon nanotube film includes a plurality of carbon nanotubes arranged along a preferred direction. The length of the sound wave generator 14 is about 3 centimeters, the width thereof is about 3 centimeters, and the thickness thereof is about 50 nanometers. It can be understood that when the thickness of the sound wave generator 14 is small, for example, less than 10 micrometers, the sound wave generator 14 has greater transparency. Thus, it is possible to acquire a transparent thermoacoustic device by employing a transparent sound wave generator 14 comprising of a transparent carbon nanotube film in the thermoacoustic device 10. The transparent thermoacoustic device 10 can be located on the surface of a variety of display devices, such as a mobile phone or LCD. Moreover, the transparent sound wave generator 14 can even be placed on the surface of a painting. In addition, employing the transparent sound wave generator 14 can result in the saving of space by replacing typical speakers with a thermoacoustic device anywhere, even in front of areas where elements are viewed. It can also be employed in areas in which conventional speakers have proven to be to bulky and/or heavy. The sound wave generator of all embodiments can be relatively lightweight when compared to traditional speakers. Thus the sound wave generator can be employed in a variety of situations that were not even available to traditional speakers.

The first electrode 142 and the second electrode 144 are made of conductive material. The shape of the first electrode 142 or the second electrode 144 is not limited and can be lamellar, rod, wire, and block among other shapes. Materials of the first electrode 142 and the second electrode 144 can be metals, conductive adhesives, carbon nanotubes, and indium tin oxides among other materials. In one embodiment, the first electrode 142 and the second electrode 144 are rod-shaped metal electrodes. The sound wave generator 14 is electrically connected to the first electrode 142 and the second electrode 144. The electrodes can provide structural support for the sound wave generator 14. Because, some of the carbon nanotube structures have large specific surface area, some sound wave generators 14 can be adhered directly to the first electrode 142 and the second electrode 144 and/or many other surfaces. This will result in a good electrical contact between the sound wave generator 14 and the electrodes 142, 144. The first electrode 142 and the second electrode 144 can be electrically connected to two ends of the signal device 12 by a conductive wire 149.

In other embodiments, a conductive adhesive layer (not shown) can be further provided between the first electrode 142 or the second electrode 144 and the sound wave generator 14. The conductive adhesive layer can be applied to the surface of the sound wave generator 14. The conductive adhesive layer can be used to provide electrical contact and more adhesion between the electrodes 142 or 144 and the sound wave generator 14. In one embodiment, the conductive adhesive layer is a layer of silver paste.

The signal device 12 can include the electrical signal devices, pulsating direct current signal devices, alternating current devices and/or electromagnetic wave signal devices (e.g., optical signal devices, lasers). The signals input from the signal device 12 to the sound wave generator 14 can be, for example, electromagnetic waves (e.g., optical signals), electrical signals (e.g., alternating electrical current, pulsating direct current signals, signal devices and/or audio electrical signals) or a combination thereof. Energy of the signals is absorbed by the carbon nanotube structure and then radiated as heat. This heating causes detectable sound signals due to pressure variation in the surrounding (environmental) medium. It can be understood that the signals are different according to the specific application of the thermoacoustic device 10. When the thermoacoustic device 10 is applied to an earphone, the input signals can be AC electrical signals or audio signals. When the thermoacoustic device 10 is applied to a photoacoustic spectrum device, the input signals are optical signals. In the embodiment of FIG. 1, the signal device 12 is an electric signal device, and the input signals are electric signals.

It also can be understood that the first electrode 142 and the second electrode 144 are optional according to different signal devices 12, e.g., when the signals are electromagnetic wave or light, the signal device 12 can input signals to the sound wave generator 14 without the first electrode 142 and the second electrode 144.

The carbon nanotube structure comprises a plurality of carbon nanotubes and has a small heat capacity per unit area. The carbon nanotube structure can have a large area for causing the pressure oscillation in the surrounding medium by the temperature waves generated by the sound wave generator 14. In use, when signals, e.g., electrical signals, with variations in the application of the signal and/or strength are input applied to the carbon nanotube structure of the sound wave generator 14, heating is produced in the carbon nanotube structure according to the variations of the signal and/or signal strength. Temperature waves, which are propagated into surrounding medium, are obtained. The temperature waves produce pressure waves in the surrounding medium, resulting in sound generation. In this process, it is the thermal expansion and contraction of the medium in the vicinity of the sound wave generator 14 that produces sound. This is distinct from the mechanism of the conventional loudspeaker, in which the pressure waves are created by the mechanical movement of the diaphragm. When the input signals are electrical signals, the operating principle of the thermoacoustic device 10 is an "electrical-thermal-sound" conversion. When the input signals are optical signals, the operation principle of the thermoacoustic device 10 is an "optical-thermal-sound" conversion. Energy of the optical signals can be absorbed by the sound wave generator 14 and the resulting energy will then be radiated as heat. This heat causes detectable sound signals due to pressure variation in the surrounding (environmental) medium.

Figure 9:
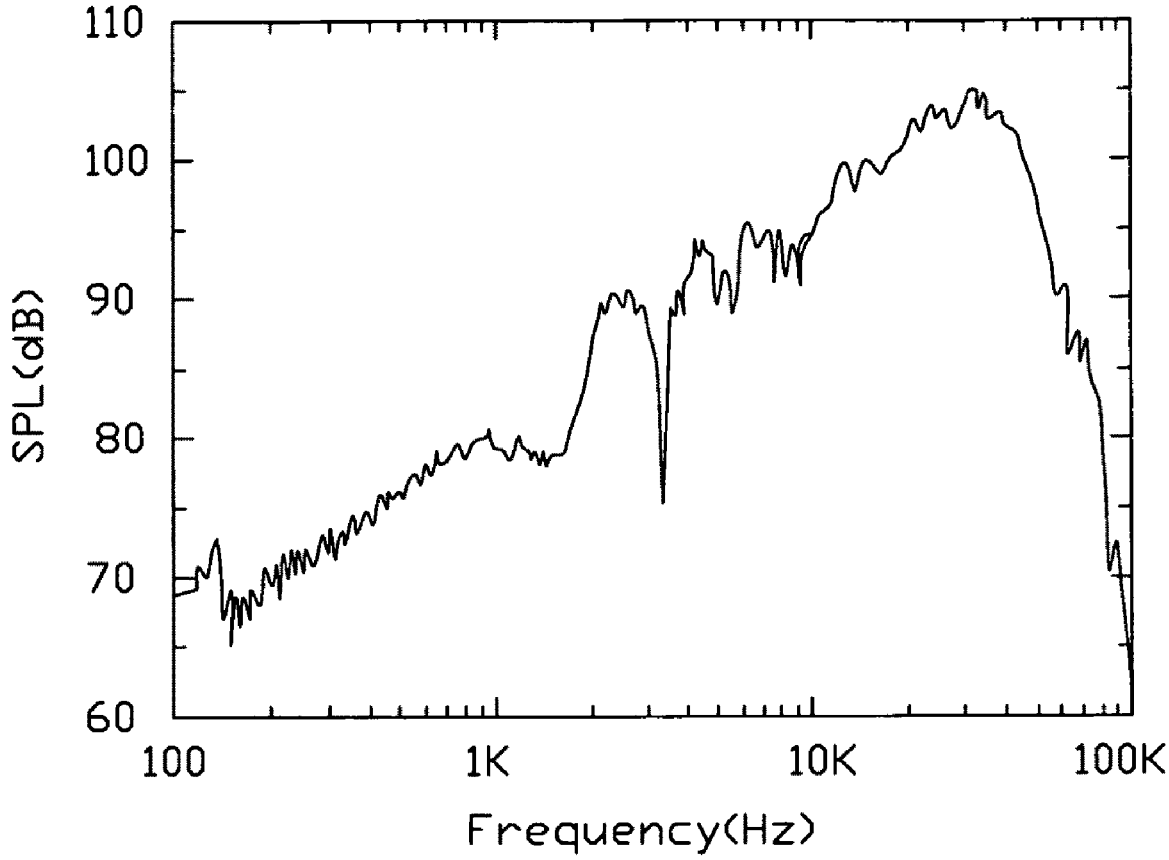
FIG. 9 is a frequency response curve of one embodiment of the thermoacoustic device.

FIG. 9 shows a frequency response curve of the thermoacoustic device 10 according to the embodiment described in FIG. 1. To obtain these results, an alternating electrical signal with 50 volts is applied to the carbon nanotube structure. A microphone put about 5 centimeters away from the in front of the sound wave generator 14 is used to measure the performance of the thermoacoustic device 10. As shown in FIG. 9, the thermoacoustic device 10, of the embodiment shown in FIG. 1, has a wide frequency response range and a high sound pressure level. The sound pressure level of the sound waves generated by the thermoacoustic device 10 can be greater than 50 dB. The sound pressure level generated by the thermoacoustic device 10 reaches up to 105 dB. The frequency response range of the thermoacoustic device 10 can be from about 1 Hz to about 100 KHz with power input of 4.5 W. The total harmonic distortion of the thermoacoustic device 10 is extremely small, e.g., less than 3% in a range from about 500 Hz to 40 KHz.

In one embodiment, the carbon nanotube structure of the thermoacoustic device 10 includes five carbon nanotube wire structures, a distance between adjacent two carbon nanotube wire structures is 1 centimeter, and a diameter of the carbon nanotube wire structures is 50 micrometers, when an alternating electrical signals with 50 volts is applied to the carbon nanotube structure, the sound pressure level of the sound waves generated by the thermoacoustic device 10 can be greater than about 50 dB, and less than about 95 dB. The sound wave pressure generated by the thermoacoustic device 10 reaches up to 100 dB. The frequency response range of one embodiment thermoacoustic device 10 can be from about 100 Hz to about 100 KHz with power input of 4.5 W.

Further, since the carbon nanotube structure has an excellent mechanical strength and toughness, the carbon nanotube structure can be tailored to any desirable shape and size, allowing a thermoacoustic device 10 of most any desired shape and size to be achieved. The thermoacoustic device 10 can be applied to a variety of other acoustic devices, such as sound systems, mobile phones, MP3s, MP4s, TVs, computers, and so on. It can also be applied to flexible articles such as clothing and flags.

Figure 10:
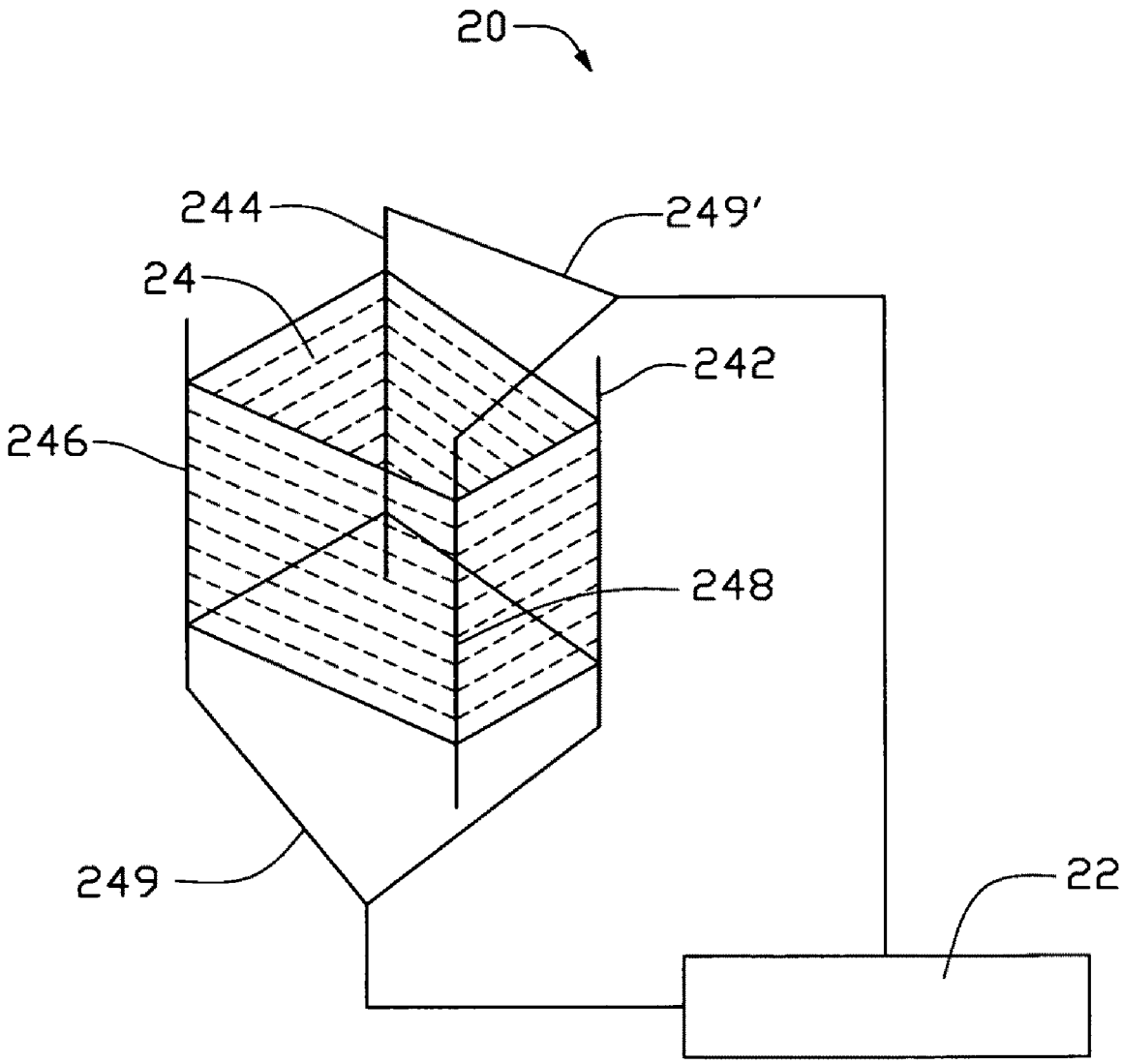
FIG. 10 is a schematic structural view of a thermoacoustic device in accordance with one embodiment.

Referring to FIG. 10, a thermoacoustic device 20, according to another embodiment, includes a signal device 22, a sound wave generator 24, a first electrode 242, a second electrode 244, a third electrode 246, and a fourth electrode 248.

The compositions, features and functions of the thermoacoustic device 20 in the embodiment shown in FIG. 10 are similar to the thermoacoustic device 10 in the embodiment shown in FIG. 1. The difference is that, the present thermoacoustic device 20 includes four electrodes, the first electrode 242, the second electrode 244, the third electrode 246, and the fourth electrode 248. The first electrode 242, the second electrode 244, the third electrode 246, and the fourth electrode 248 are all rod-like metal electrodes, located apart from each other. The first electrode 242, the second electrode 244, the third electrode 246, and the fourth electrode 248 form a three dimensional structure. The sound wave generator 24 surrounds the first electrode 242, the second electrode 244, the third electrode 246, and the fourth electrode 248. The sound wave generator 24 is electrically connected to the first electrode 242, the second electrode 244, the third electrode 246, and the fourth electrode 248. As shown in the FIG. 10, the first electrode 242 and the third electrode 246 are electrically connected in parallel to one terminal of the signal device 22 by a first conductive wire 249. The second electrode 244 and the fourth electrode 248 are electrically connected in parallel to the other terminal of the signal device 22 by a second conductive wire 249'. The parallel connections in the sound wave generator 24 provide for lower resistance, thus input voltage required to the thermoacoustic device 20, can be lowered. The sound wave generator 24, according to the present embodiment, can radiate thermal energy out to surrounding medium, and thus create sound. It is understood that the first electrode 242, the second electrode 244, the third electrode 246, and the fourth electrode 248 also can be configured to and serve as a support for the sound wave generator 24.

Figure 11:
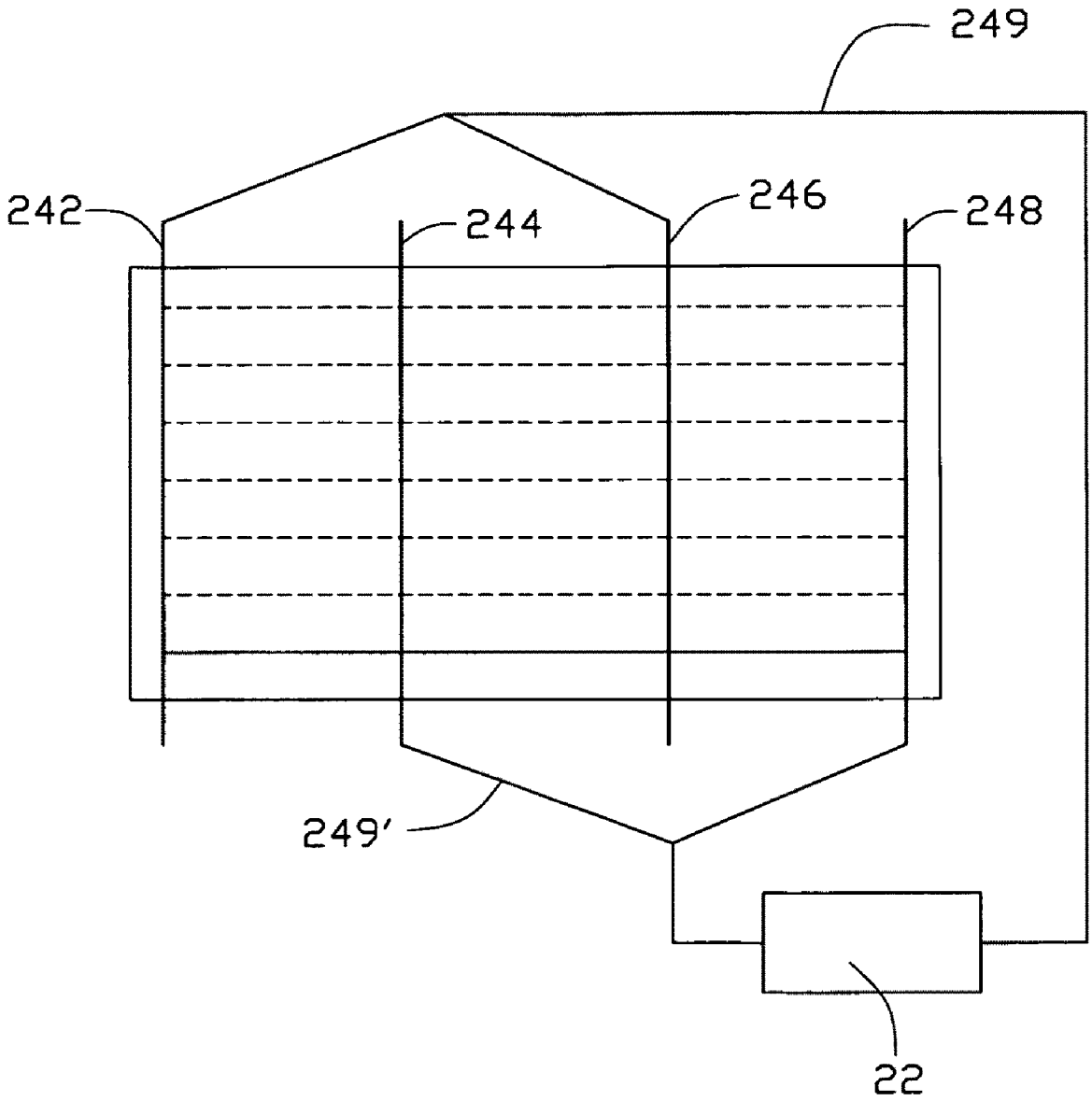
FIG. 11 is a schematic structural view of a thermoacoustic device with four coplanar electrodes.

It is to be understood that the first electrode 242, the second electrode 244, the third electrode 246, and the fourth electrode 248 also can be coplanar, as can be seen in FIG. 11. Further, a plurality of electrodes, such as more than four electrodes, can be employed in the thermoacoustic device 20 according to needs following the same pattern of parallel connections as when four electrodes are employed.

Figure 12:
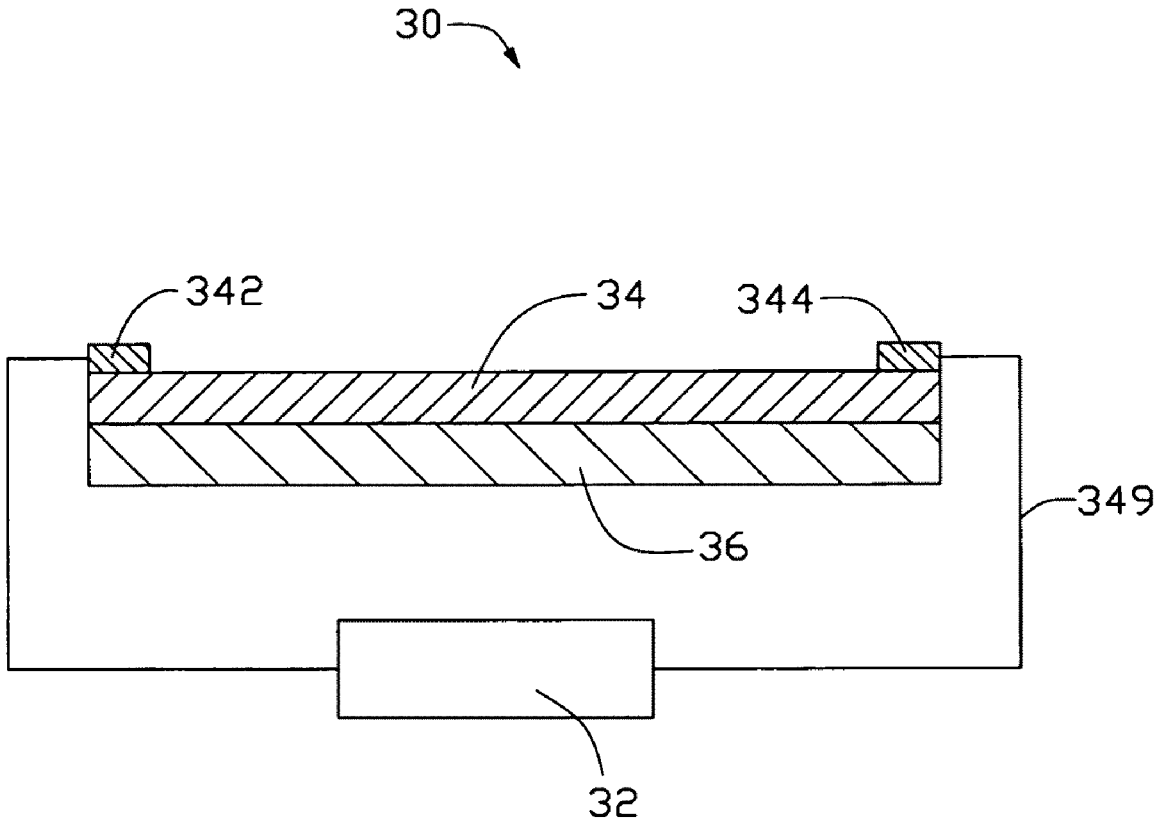
FIG. 12 is a schematic structural view of a thermoacoustic device employing a framing element in accordance with one embodiment.

Referring to FIG. 12, a thermoacoustic device 30 according to another embodiment includes a signal device 32, a sound wave generator 34, a supporting element 36, a first electrode 342, and a second electrode 344.

The compositions, features and functions of the thermoacoustic device 30 in the embodiment shown in FIG. 12 are similar to the thermoacoustic device 10 in the embodiment shown in FIG. 1. The difference is that the present thermoacoustic device 30 includes the supporting element 36, and the sound wave generator 34 is located on a surface of the supporting element 36.

The supporting element 36 is configured for supporting the sound wave generator 34. A shape of the supporting element 36 is not limited, nor is the shape of the sound wave generator 34. The supporting element 36 can have a planar and/or a curved surface. The supporting element 36 can also have a surface where the sound wave generator 34 is can be securely located, exposed or hidden. The supporting element 36 may be, for example, a wall, a desk, a screen, a fabric or a display (electronic or not). The sound wave generator 34 can be located directly on and in contact with the surface of the supporting element 36.

The material of the supporting element 36 is not limited, and can be a rigid material, such as diamond, glass or quartz, or a flexible material, such as plastic, resin or fabric. The supporting element 36 can have a good thermal insulating property, thereby preventing the supporting element 36 from absorbing the heat generated by the sound wave generator 34. In addition, the supporting element 36 can have a relatively rough surface, thereby the sound wave generator 34 can have an increased contact area with the surrounding medium.

Since the carbon nanotubes structure has a large specific surface area, the sound wave generator 34 can be adhered directly on the supporting element 36 in good contact.

An adhesive layer (not shown) can be further provided between the sound wave generator 34 and the supporting element 36. The adhesive layer can be located on the surface of the sound wave generator 34. The adhesive layer can provide a better bond between the sound wave generator 34 and the supporting element 36. In one embodiment, the adhesive layer is conductive and a layer of silver paste is used. A thermally insulative adhesive can also be selected as the adhesive layer Electrodes can be connected on any surface of the carbon nanotube structure. The first electrode 342 and the second electrode 344 can be on the same surface of the sound wave generator 34 or on two different surfaces of the sound wave generator 34. It is understood that more than two electrodes can be on surface(s) of the sound wave generator 34, and be connected in the manner described above.

The signal device 32 can be connected to the sound wave generator 34 directly via a conductive wire. Anyway that can electrically connect the signal device 32 to the sound wave generator 34 and thereby input signal to the sound wave generator 34 can be adopted.

Figure 13:
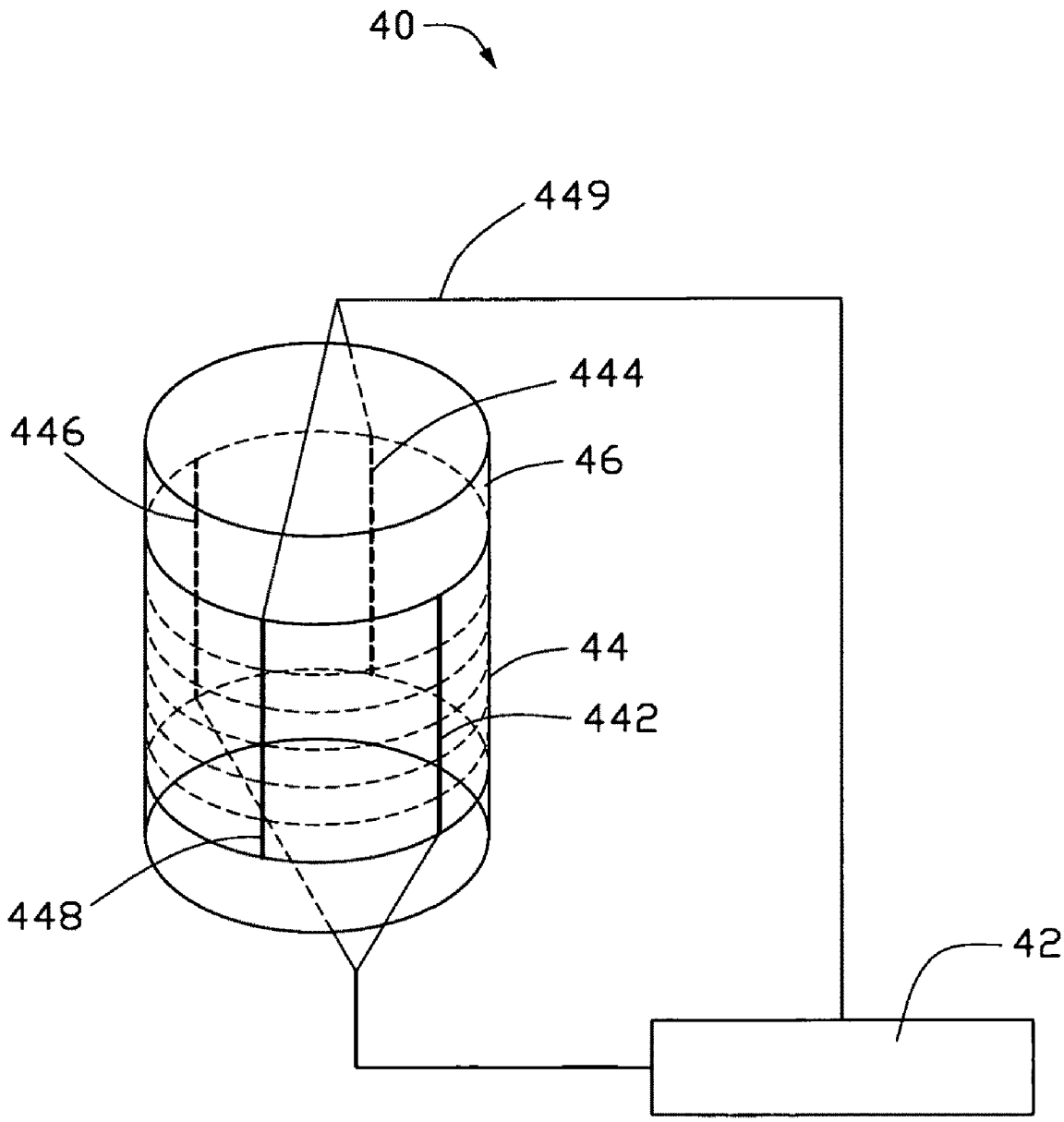
FIG. 13 is a schematic structural view of a three dimensional thermoacoustic device in accordance with one embodiment.

Referring to FIG. 13, an thermoacoustic device 40 according to another embodiment includes a signal device 42, a sound wave generator 44, a supporting element 46, a first electrode 442, a second electrode 444, a third electrode 446, and a fourth electrode 448.

The compositions, features and functions of the thermoacoustic device 40 in the embodiment shown in FIG. 13 are similar to the thermoacoustic device 30 in the embodiment shown in FIG. 12. The difference is that the sound wave generator 44 as shown in FIG. 13 surrounds the supporting element 46. A shape of the supporting element 46 is not limited, and can be most any three or two dimensional structure, such as a cube, a cone, or a cylinder. In one embodiment, the supporting element 46 is cylinder-shaped. The first electrode 442, the second electrode 444, the third electrode 446, and the fourth electrode 448 are separately located on a surface of the sound wave generator 44 and electrically connected to the sound wave generator 44. Connections between the first electrode 442, the second electrode 444, the third electrode 446, the fourth electrode 448 and the signal device 42 can be the same as described in the embodiment as shown in FIG. 10. It can be understood that a number of electrodes other than four can be in contact with the sound wave generator 44.

Figure 14:
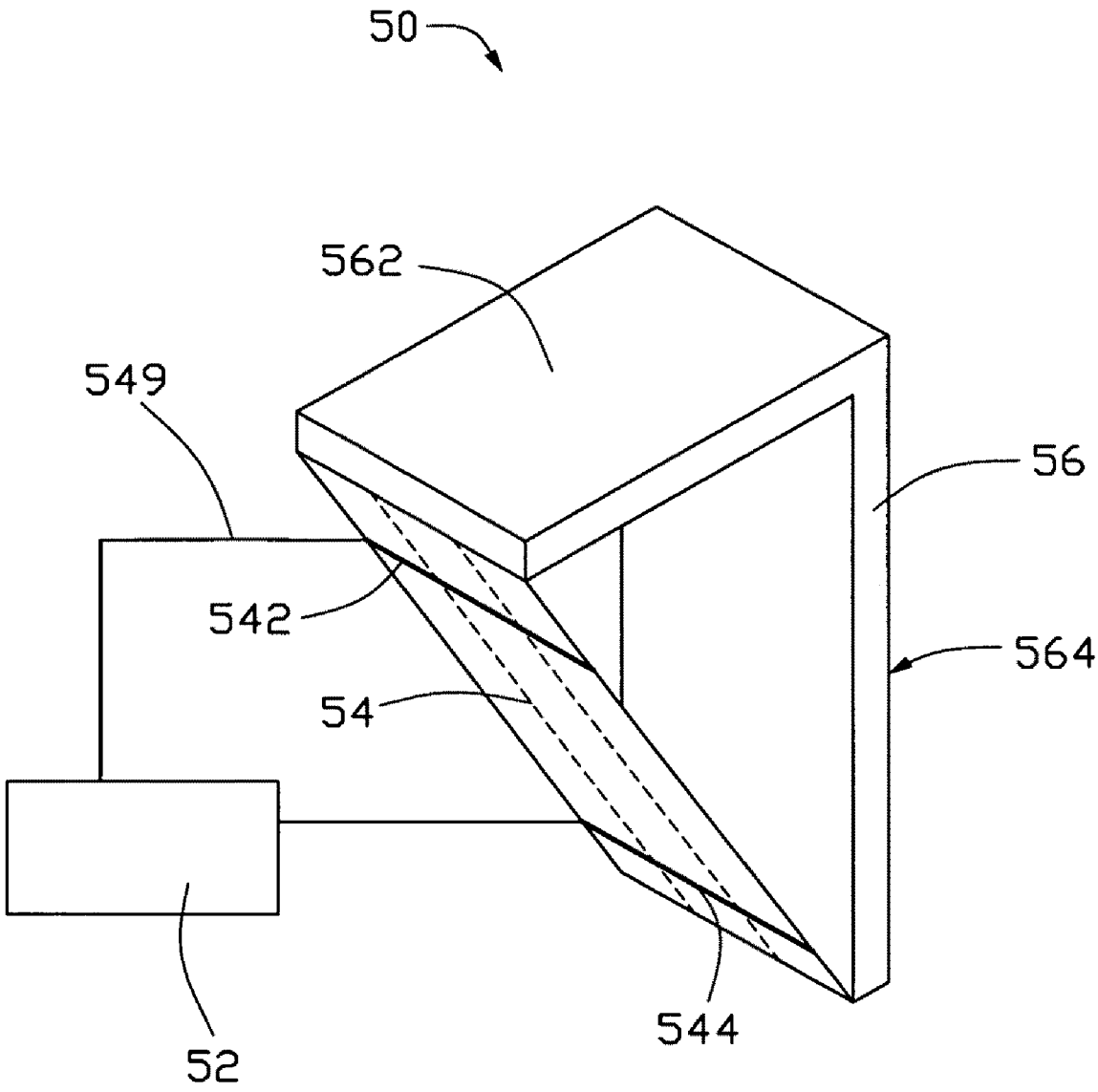
FIG. 14 is a schematic structural view of a thermoacoustic device with a sound collection space in accordance with one embodiment.

Referring to FIG. 14, a thermoacoustic device 50 according to another embodiment includes a signal device 52, a sound wave generator 54, a framing element 56, a first electrode 542, and a second electrode 544.

The compositions, features, and functions of the thermoacoustic device 50 in the embodiment shown in FIG. 14 are similar to the thermoacoustic device 30 as shown in FIG. 12. The difference is that a portion of the sound wave generator 54 is located on a surface of the framing element 56 and a sound collection space is defined by the sound wave generator 54 and the framing element 56. The sound collection space can be a closed space or an open space. In the present embodiment, the framing element 56 has an L-shaped structure. In other embodiments, the framing element 56 can have an U-shaped structure or any cavity structure with an opening. The sound wave generator 54 can cover the opening of the framing element 56 to form a Helmholtz resonator. It is to be understood that the sound producing device 50 also can have two or more framing elements 56, the two or more framing elements 56 are used to collectively suspend the sound wave generator 54. A material of the framing element 56 can be selected from suitable materials including wood, plastics, metal and glass. Referring to FIG. 14, the framing element 56 includes a first portion 562 connected at right angles to a second portion 564 to form the L-shaped structure of the framing element 56. The sound wave generator 54 extends from the distal end of the first portion 562 to the distal end of the second portion 564, resulting in a sound collection space defined by the sound wave generator 54 in cooperation with the L-shaped structure of the framing element 56. The first electrode 542 and the second electrode 544 are connected to a surface of the sound wave generator 54. The first electrode 542 and the second electrode 544 are electrically connected to the signal device 52. Sound waves generated by the sound wave generator 54 can be reflected by the inside wall of the framing element 56, thereby enhancing acoustic performance of the thermoacoustic device 50. It is understood that a framing element 56 can take any shape so that carbon nanotube structure is suspended, even if no space is defined.

Figure 15:
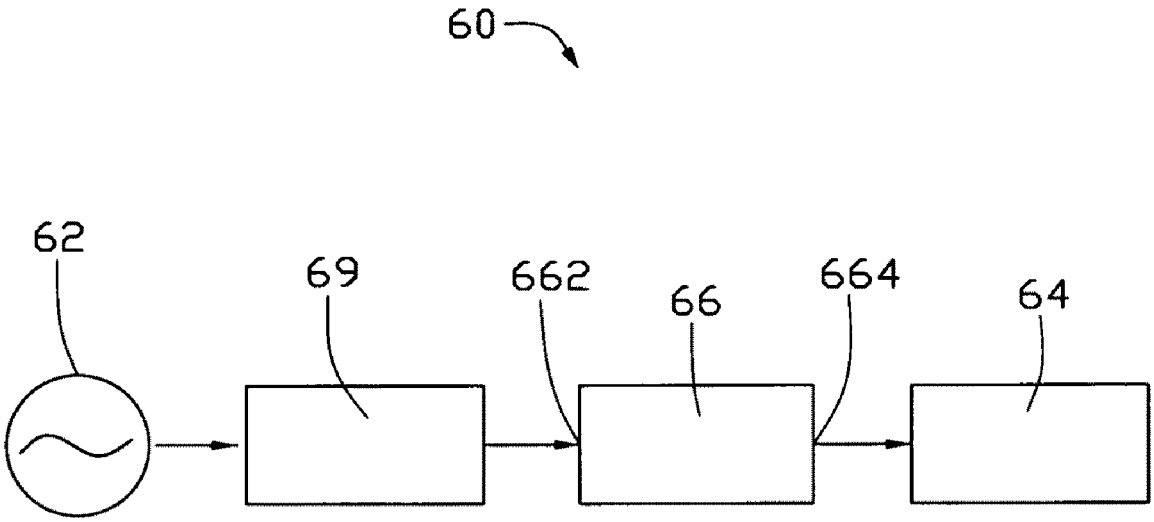
FIG. 15 is a schematic view of elements in a thermoacoustic device in accordance with one embodiment.
Figure 16:
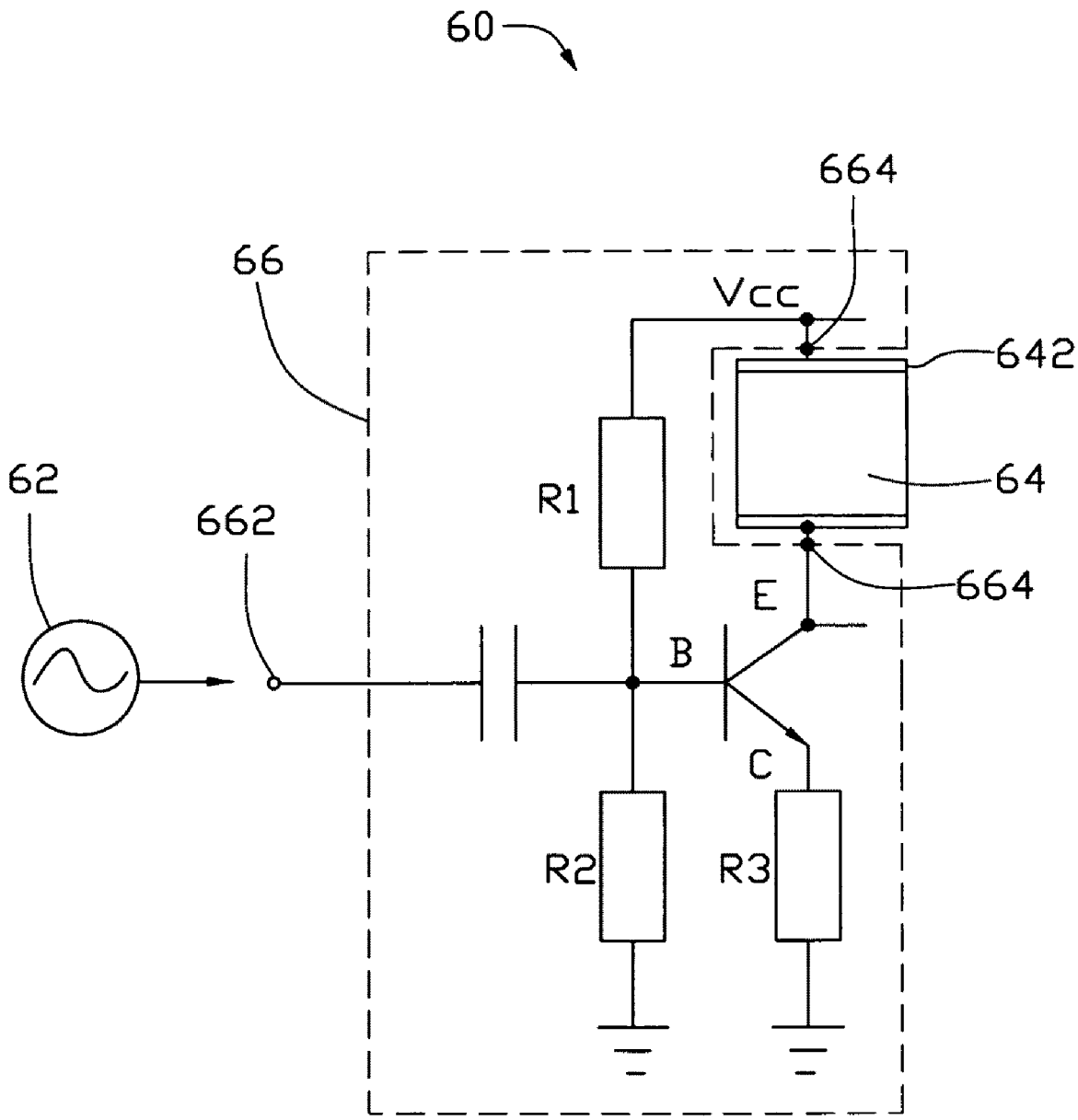
FIG. 16 is a schematic view of a circuit according to one embodiment of the invention.

Referring to FIGS. 15 and 16, a thermoacoustic device 60 according to another embodiment includes a signal device 62, a sound wave generator 64, two electrodes 642, and a power amplifier 66.

The compositions, features, and functions of the thermoacoustic device 60 in the embodiment shown in FIGS. 15-16 are similar to the thermoacoustic device 10 in the embodiment shown in FIG. 1. The difference is that the thermoacoustic device 60 further includes a power amplifier 66. The power amplifier 66 is electrically connected to the signal device 62. Specifically, the signal device 62 includes a signal output (not shown), and the power amplifier 66 is electrically connected to the signal output of the signal device 62. The power amplifier 66 is configured for amplifying the power of the signals output from the signal device 62 and sending the amplified signals to the sound wave generator 64. The power amplifier 66 includes two outputs 664 and one input 662. The input 662 of the power amplifier 66 is electrically connected to the signal device 62 and the outputs 664 thereof are electrically connected to the sound wave generator 64.

Figure 17:
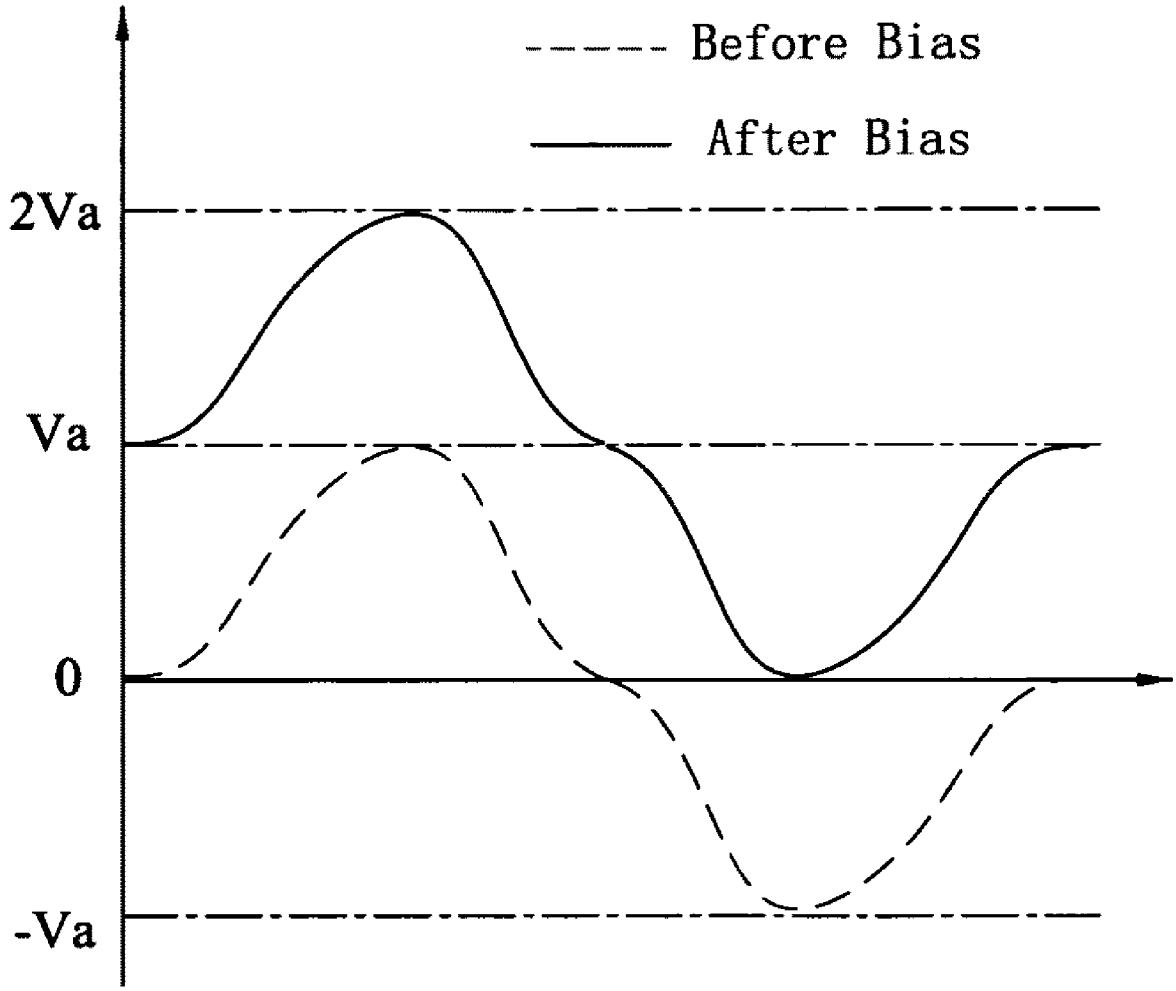
FIG. 17 is a schematic view showing a voltage bias using a power amplifier.

When using alternating current, and since the operating principle of the thermoacoustic device 60 is the "electrical-thermal-sound" conversion, a direct consequence is that the frequency of the output signals of the sound wave generator 64 doubles that of the input signals. This is because when an alternating current passes through the sound wave generator 64, the sound wave generator 64 is heated during both positive and negative half-cycles. This double heating results in a double frequency temperature oscillation as well as a double frequency sound pressure. Thus, when a conventional power amplifier, such as a bipolar amplifier, is used to drive the sound wave generator 64, the output signals, such as the human voice or music, sound strange because of the output signals of the sound wave generator 64 doubles that of the input signals. The effects of this can be seen in FIG. 17.

The power amplifier 66 can send amplified signals, such as voltage signals, with a bias voltage to the sound wave generator 64 to reproduce the input signals faithfully. Referring to FIG. 16, the power amplifier 66 can be a class A power amplifier, that includes a first resistor R1, a second resistor R2, a third resistor R3, a capacitor and a triode transistor. The transistor includes a base B, an emitter E, and a collector C. The capacitor is electrically connected to the signal output end of the signal device 62 and to the base B of the transistor. A DC voltage Vcc is connected in series with the first resistor R1 that is connected to the base B of the transistor. The base B of the transistor is connected in series to the second resistor R2 that is grounded. The emitter E is electrically connected to one output end 664 of the power amplifier 66. The DC voltage Vcc is electrically connected to the other output end 664 of the power amplifier 66. The collector C is connected in series to the third resistor R3 that is grounded. The two output ends 664 of the power amplifier 66 are electrically connected to the two electrodes 642. In one embodiment, the emitter E of the transistor is electrically connected to one of the electrodes 642. The DC voltage Vcc is electrically connected to the other electrode of the electrodes 642 to connect the sound wave generator 64 to the emitter E of the transistor in series.

It is understood that a number of electrodes can be electrically connected to the sound wave generator 64. Any adjacent two electrodes are electrically connected to different ends 664 of the power amplifier 66.

It is understood that the electrodes are optional. The two output ends 664 of the power amplifier 66 can be electrically connected to the sound wave generator 64 by conductive wire or any other conductive means.

It is also understood that the power amplifier 66 is not limited to the class A power amplifier. Any power amplifier that can output amplified voltage signals with a bias voltage to the sound wave generator 64, so that the amplified voltage signals are all positive or negative, is capable of being used. Referring to the embodiment shown in FIG. 17, the output amplified voltage signals with a bias voltage of the power amplifier 66 are all positive.

In other embodiments, referring to FIG. 15, a reducing frequency circuit 69 can be further provided to reduce the frequency of the output signals from the signal device 62, e.g., reducing half of the frequency of the signals, and sending the signals with reduced frequency to the power amplifier 66. The power amplifier 66 can be a conventional power amplifier, such as a bipolar amplifier, without applying amplified voltage signals with a bias voltage to the sound wave generator 64. It is understood that the reducing frequency circuit 69 also can be integrated with the power amplifier 66 without applying amplified voltage signals with a bias voltage to the sound wave generator 64.

Figure 18:
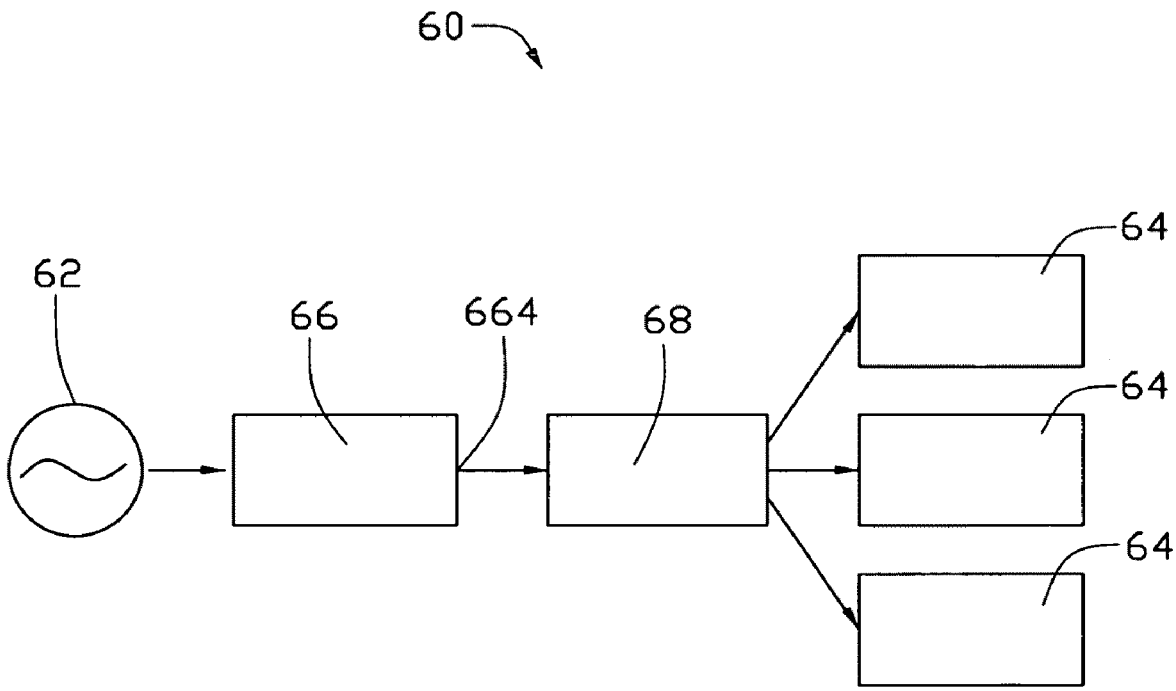
FIG. 18 is a schematic view of the thermoacoustic device employing a scaler being connected to the output ends of the power amplifier.
Figure 19:
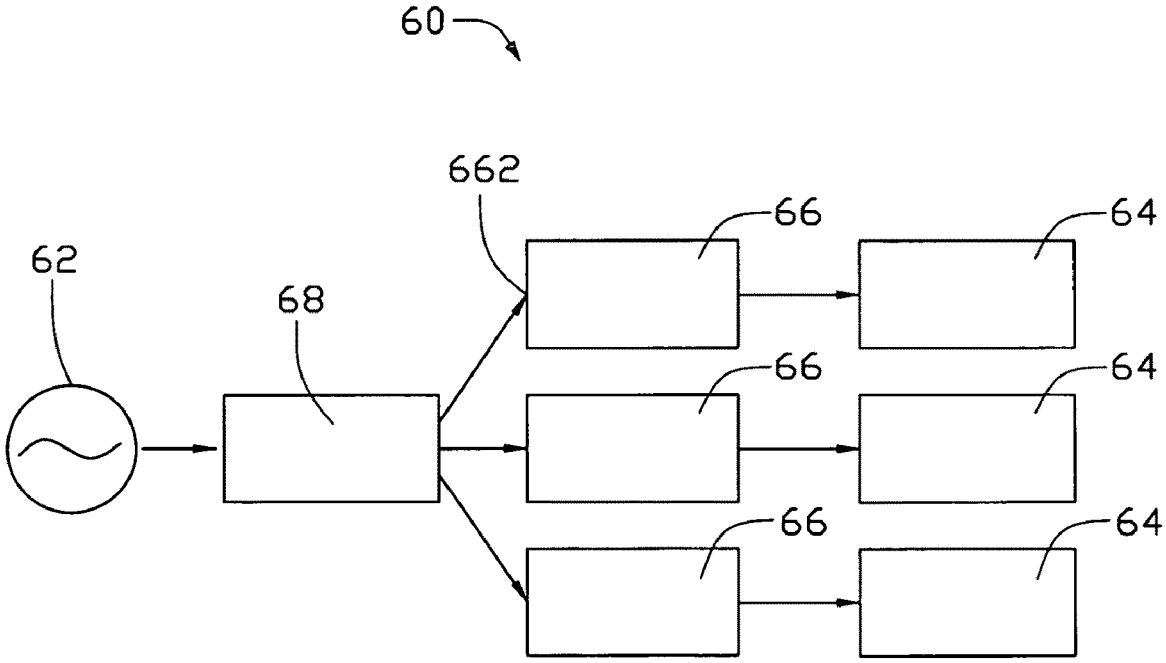
FIG. 19 is a schematic view of the thermoacoustic device employing scalers being connected to the input ends of the power amplifier.

Referring to FIGS. 18 and 19, the thermoacoustic device 60 can further include a plurality of sound wave generators 64 and a scaler 68. The scaler 68 can be connected to the output ends 664 or the input end 662 of the power amplifier 66. Referring to FIG. 18, when the scaler 68 is connected to the output ends 664 of the power amplifier 66, the scaler 68 can divide the amplified voltage output signals from the power amplifier 66 into a plurality of sub-signals with different frequency bands, and send each sub-signal to each sound wave generator 64. Referring to FIG. 19, when the scaler 68 is connected to the input end 662 of the power amplifier 66, the thermoacoustic device 60 includes a plurality of power amplifiers 66. The scaler 68 can divide the output signals from the signal device 62 into a plurality of sub-signals with different frequency bands, and send each sub-signal to each power amplifier 66. Each power amplifier 66 is corresponding to one sound wave generator 64.

Figure 20:
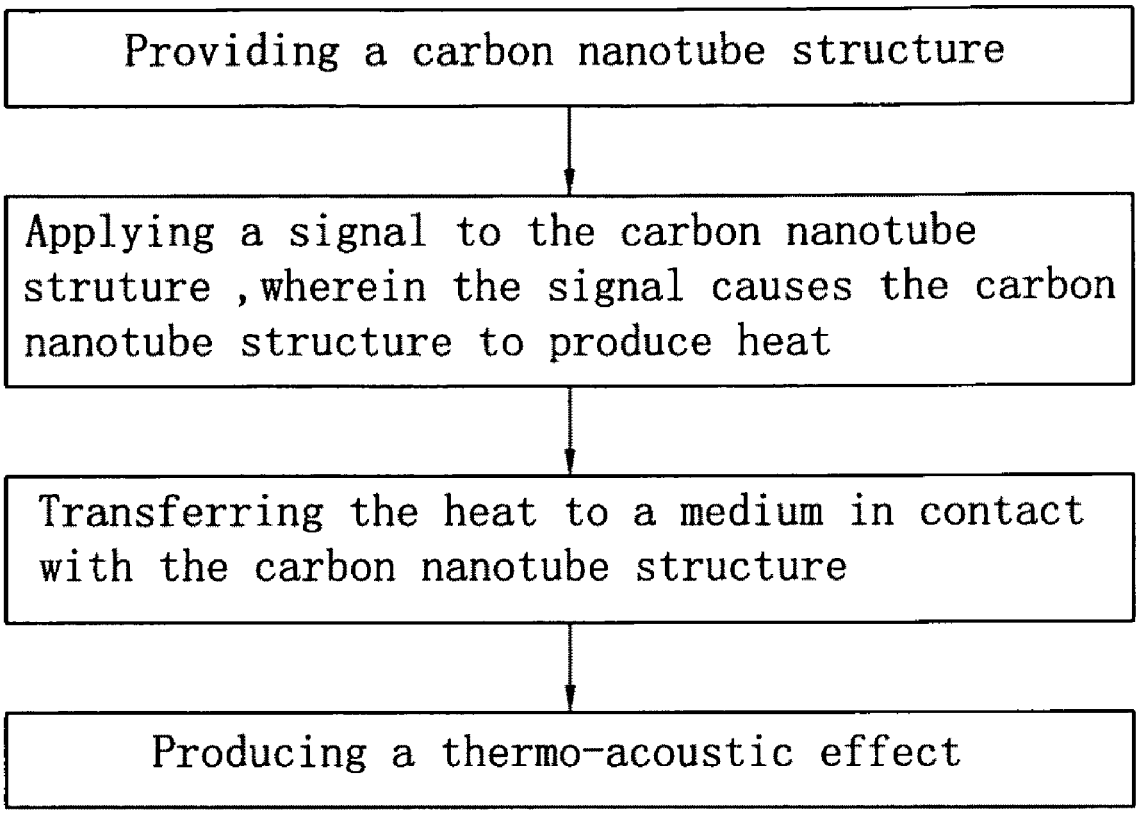
FIG. 20 is a chart of a method for generating sound waves.
Figure 21:
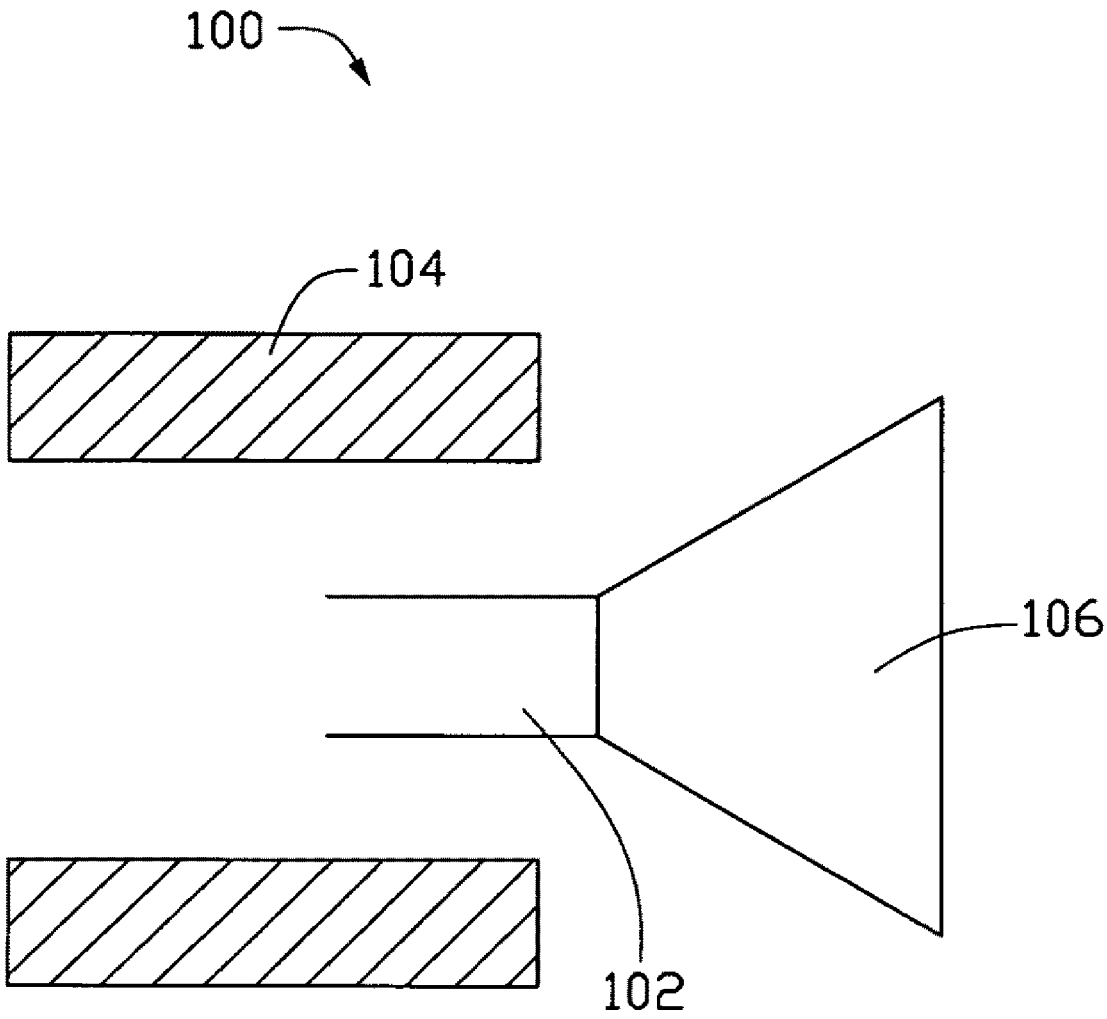
FIG. 21 is a schematic structural view of a conventional loudspeaker according to the prior art.

Referring to FIG. 20, a method for producing sound waves is further provided. The method includes the following steps of: (a) providing a carbon nanotube structure; (b) applying a signal to the carbon nanotube structure, wherein the signal causes the carbon nanotube structure produces heat: (c) heating a medium in contact with the carbon nanotube structure; and (d) producing a thermoacoustic effect.

In step (a), the carbon nanotube structure can be the same as that in the thermoacoustic device 10. In step (b), there is a variation in the signal and the variation of the signal is selected from the group consisting of digital signals, changes in intensity, changes in duration, changes in cycle, and combinations thereof. The signal can be applied to the carbon nanotube structure by at least two electrodes from a signal device. Other means, such as lasers and other electromagnetic signals can be used. When the signals are applied to the carbon nanotube structure, heating is produced in the carbon nanotube structure according to the variations of the signals. In steps (c) and (d), the carbon nanotube structure transfers heat to the medium in response to the signal and the heating of the medium causes thermal expansion of the medium. It is the cycle of relative heating that results in sound wave generation. This is known as the thermoacoustic effect, an effect that has suggested to be the reason that lightening creates thunder.

It is also to be understood that the above description and the claims drawn to a method may include some indication in reference to certain steps. However, the indication used is only to be viewed for identification purposes and not as a suggestion as to an order for the steps.

Finally, it is to be understood that the above-described embodiments are intended to illustrate rather than limit the invention. Variations may be made to the embodiments without departing from the spirit of the invention as claimed. Elements associated with any of the above embodiments are envisioned to be associated with any other embodiments. The above-described embodiments illustrate the scope of the invention but do not restrict the scope of the invention.

What is claimed is:

1. An apparatus, the apparatus comprising:

a signal device;

a supporting element;

a sound wave generator, at least portion of the sound wave generator is supported by the supporting element, the sound wave generator comprises of a carbon nanotube structure, the carbon nanotube structure comprises of one or more carbon nanotube films, each carbon nanotube film comprises a plurality of carbon nanotubes substantially parallel to each other and joined side by side via van der Waals attractive force therebetween; and the signal device transmits a signal to the carbon nanotube structure;

wherein the one or more carbon nanotube films convert the signals into heat; and, the heat is transferred to a medium in contact with the sound wave generator causing a thermoacoustic effect.

2. The apparatus of claim 1, wherein heat capacity per unit area of the carbon nanotube structure is less than $2\times10^{-4}$ J/cm$^2$*K.

3. The apparatus of claim 1, wherein the heat capacity per unit area of the carbon nanotube structure is less than $1.7\times10^{-6}$ J/cm$^2$*K.

4. The apparatus of claim 1, wherein the one or more carbon nanotube films is the length of one carbon nanotube segment, the carbon nanotube segment comprises of a plurality of carbon nanotubes.

5. The apparatus of claim 4, wherein the carbon nanotubes are substantially the same length.

6. The apparatus of claim 1, wherein the carbon nanotube structure comprises two or more stacked carbon nanotube films, and adjacent two carbon nanotube films are attracted by van der Waals attractive force therebetween.

7. The apparatus of claim 6, wherein the alignment directions of the two or more stacked carbon nanotube films are set at an angle.

8. The apparatus of claim 1, wherein at least one carbon nanotube spans the entire length of the carbon nanotube film.

9. The apparatus of claim 1, wherein a length of the carbon nanotube film is substantially equal to a length of each carbon nanotube.

10. The apparatus of claim 1, wherein a thickness of the sound wave generator ranges from about 0.5 nanometers to about 1 millimeter.

11. The apparatus of claim 1, wherein the sound wave generator is located on a surface of the supporting element.

12. The apparatus of claim 1, further comprising a framing element, wherein at least part of the supporting element is suspended by the framing element.

13. The apparatus of claim 12, wherein the framing element and the supporting element, supporting at least a portion of the sound wave generator, define a sound collection space.

14. The apparatus of claim 1, wherein the supporting element has a three dimensional structure.

15. The apparatus of claim 1, wherein the supporting element comprises of a material selected from a group consisting of wood, plastic, metal and glass diamond, glass, quartz, plastic, resin and fabric.

16. The apparatus of claim 1, further comprising at least two electrodes, the at least two electrodes are electrically connected to the carbon nanotube structure.

17. The apparatus of claim 16, wherein the at least two electrodes are electrically connected to the signal device.

18. The apparatus of claim 17, wherein any two adjacent electrodes are electrically connected to different terminals of the signal device.

19. The apparatus of claim 16, wherein the at least two electrodes have a shape selected from a group consisting of lamella, rod, film, wire and block.

20. The apparatus of claim 16, wherein at least one of the electrodes comprises of a material selected from a group consisting of metals, conductive adhesives, carbon nanotubes, and indium tin oxides.

21. The apparatus of claim 16, further comprising a conductive adhesive layer located between the each electrode and at least one carbon nanotube film.

22. The apparatus of claim 1, wherein the signal from the signal device is selected from a group consisting of pulsating direct current, alternating electrical current and combinations thereof.

23. The apparatus of claim 1, wherein there is a variation in the signal, and the variation of the signal is selected from the group consisting of digital signals, changes in intensity, changes in duration, changes in cycle, and combinations thereof.

24. An apparatus, the apparatus comprising:

a sound wave generator capable of producing sound waves, the sound wave generator comprises one or more carbon nanotube films, the carbon nanotube film comprises a plurality of carbon nanotubes substantially parallel to each other and joined side by side via van der Waals attractive force therebetween, at least part of the one or more carbon nanotube films is supported by a supporting element;

wherein the one or more carbon nanotube films produce sound waves by repeated heating of a medium.

25. An apparatus, the apparatus comprising:

a signal device;

a sound wave generator, at least part of the sound wave generator is supported by a supporting element, and the sound wave generator comprises of one or more carbon nanotube films, the carbon nanotube films comprises a plurality of carbon nanotubes substantially parallel to each other and joined side by side via van der Waals attractive force therebetween;

wherein at least one of the one or more carbon nanotube films are in communication with the signal device; and the one or more carbon nanotube films produce sound waves by a thermoacoustic effect, in response to signals from the signal device.

26. The apparatus of claim 25, wherein the sound wave generator heats a medium adjacent to the one or more carbon nanotube films to produce the sound waves.

27. An apparatus, the apparatus comprising:

a sound wave generator, at least part of the sound wave generator is supported by a supporting element, the sound wave generator comprises one or more carbon nanotube films, the carbon nanotube films comprise a plurality of carbon nanotubes substantially parallel to each other and joined side by side via van der Waals attractive force therebetween; the sound wave generator produces sound waves by a thermoacoustic effect.

28. The apparatus of claim 27, wherein the one or more carbon nanotube films produce heat in response to receiving a signal and heats a medium so that the sound waves are created by the medium.

* * * * *